US006646550B1

(12) United States Patent
Runyon et al.

(10) Patent No.: US 6,646,550 B1
(45) Date of Patent: Nov. 11, 2003

(54) RADIO FREQUENCY SECURITY SYSTEM AND METHOD FOR A BUILDING FACILITY

(75) Inventors: Larry Runyon, Richland, WA (US); Wayne M. Gunter, Richland, WA (US); Ronald W. Gilbert, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 76 days.

(21) Appl. No.: 09/940,142

(22) Filed: Aug. 23, 2001

(51) Int. Cl.[7] ..... G08B 13/00

(52) U.S. Cl. ..... 340/541; 340/540; 340/545.1; 340/531; 340/539

(58) Field of Search ..... 340/540, 541, 340/545.1, 531, 539

(56) References Cited

U.S. PATENT DOCUMENTS

| | | | | | |
|---|---|---|---|---|---|
| 3,608,715 | A | | 9/1971 | Snyder et al. | 209/111.9 |
| 3,725,891 | A | * | 4/1973 | Miller | 340/273 |
| 3,763,795 | A | * | 10/1973 | Wetz, Jr. | 109/41 |
| 3,802,252 | A | | 4/1974 | Hayward et al. | 73/52 |
| 4,062,164 | A | | 12/1977 | Cousins | 52/489 |
| 4,223,790 | A | | 9/1980 | Yoshida | 209/590 |
| 4,234,875 | A | * | 11/1980 | Williams | 340/550 |
| 4,293,778 | A | * | 10/1981 | Williams | 340/550 |
| 4,335,375 | A | | 6/1982 | Schaeffer | 340/539 |
| 4,538,527 | A | | 9/1985 | Kitchen | 109/21 |
| 4,550,311 | A | | 10/1985 | Galloway et al. | 340/531 |
| 4,565,088 | A | | 1/1986 | Crambes | 73/61.1 |
| 4,599,831 | A | | 7/1986 | Magaha, Jr. | 52/98 |
| 4,722,435 | A | * | 2/1988 | Mareels et al. | 206/1.5 |
| 4,821,573 | A | | 4/1989 | Nagata et al. | 73/597 |
| 5,165,465 | A | | 11/1992 | Kenet | 165/2 |
| 5,200,735 | A | | 4/1993 | Hines | 340/539 |
| 5,255,564 | A | | 10/1993 | Glad et al. | 73/597 |

(List continued on next page.)

*Primary Examiner*—Daniel J. Wu
*Assistant Examiner*—Hung Nguyen
(74) *Attorney, Agent, or Firm*—Woodard, Emhardt, Moriarty, McNett & Henry LLP

(57) ABSTRACT

A security system for a building facility where radio frequency tamper-indicating devices are placed in the area of the facility to detect movement and/or relative movement of components under circumstances where such movement may indicate a security risk. One example is where there are ceiling tiles in a false ceiling which may be moved during a covert entry. An RF damage indicating device is placed at juncture locations of the tiles and tendrils of the tamper-indicating devices are positioned so that movement of one of the tiles will break the tendril and cause an alarm signal to be given. In other arrangements, tamper-indicating devices could be attached to security-sensitive objects, containers for the same, and building-related components so that movement of these security-sensitive objects would also trigger an alarm.

40 Claims, 11 Drawing Sheets

U.S. PATENT DOCUMENTS

| | | | | |
|---|---|---|---|---|
| 5,309,146 | A | 5/1994 | Kenet | |
| 5,404,755 | A | 4/1995 | Olson et al. | 73/639 |
| 5,457,997 | A | 10/1995 | Naruo et al. | 73/643 |
| 5,473,934 | A | 12/1995 | Cobb | 73/61.49 |
| 5,535,627 | A | 7/1996 | Swanson et al. | 73/597 |
| 5,559,292 | A | 9/1996 | Hull et al. | 73/597 |
| 5,572,190 | A | 11/1996 | Ross et al. | 340/541 |
| 5,600,303 | A | 2/1997 | Husseiny et al. | 340/568 |
| 5,600,700 | A | 2/1997 | Krug et al. | 378/57 |
| 5,606,130 | A | 2/1997 | Sinha et al. | 73/627 |
| 5,608,164 | A | 3/1997 | MacLauchlan | 73/599 |
| 5,610,583 | A | 3/1997 | Drebika et al. | 340/566 |
| 5,614,802 | A | 3/1997 | Nilssen | 380/20 |
| 5,616,856 | A | 4/1997 | Castel | 73/61.45 |
| 5,661,802 | A | 8/1997 | Nilssen | |
| 5,677,674 | A | 10/1997 | Wolf | 340/541 |
| 5,690,114 | A | 11/1997 | Chiang et al. | 128/661.01 |
| 5,692,029 | A | 11/1997 | Husseiny et al. | 378/88 |
| 5,698,787 | A | 12/1997 | Parzuchowski et al. | 73/643 |
| 5,748,092 | A | 5/1998 | Arsenault et al. | 340/604 |
| 5,754,498 | A | 5/1998 | Toda | 367/137 |
| 5,767,407 | A | 6/1998 | Sinha | 73/579 |
| 5,872,314 | A | 2/1999 | Clinton | 73/602 |
| 5,929,337 | A | 7/1999 | Collins et al. | 73/597 |
| 5,974,111 | A | 10/1999 | Krug et al. | 378/57 |
| 5,979,240 | A | 11/1999 | Rix et al. | 73/602 |
| 5,999,094 | A | 12/1999 | Nilssen | 340/507 |
| 6,029,530 | A | 2/2000 | Patton et al. | 73/866.5 |
| 6,049,272 | A | 4/2000 | Lee et al. | 340/539 |
| 6,078,269 | A | 6/2000 | Markwell et al. | 340/825.5 |
| 6,094,140 | A | 7/2000 | Parente | 340/573.1 |
| 6,234,023 | B1 | 5/2001 | Collins et al. | 73/597 |

* cited by examiner

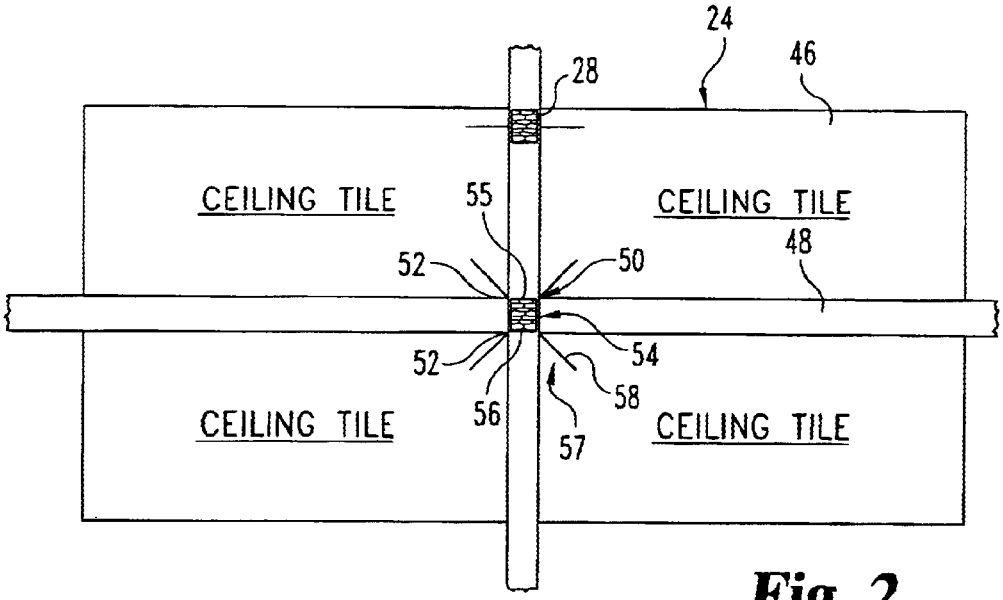
Fig. 2
Fig. 3
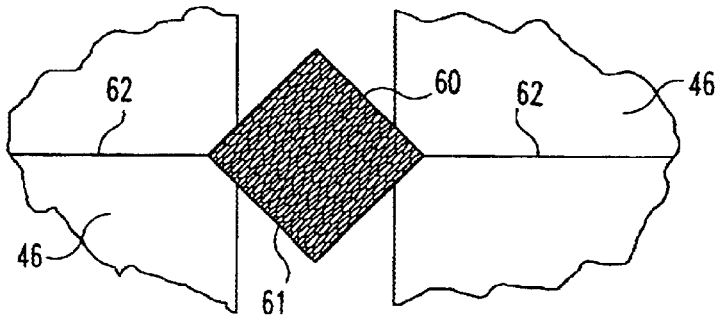
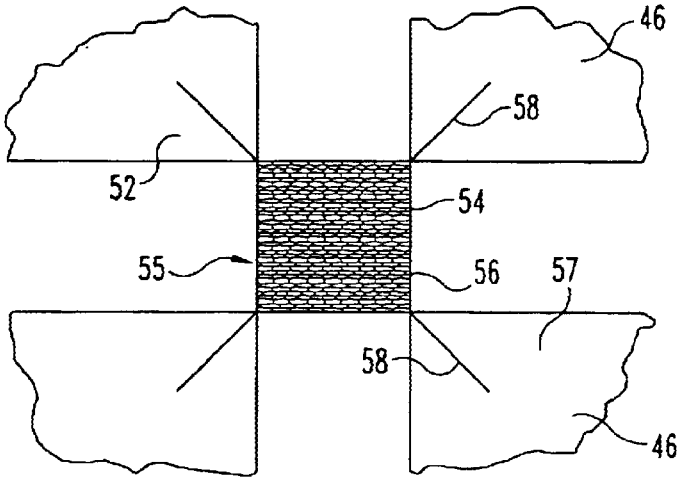
Fig. 4

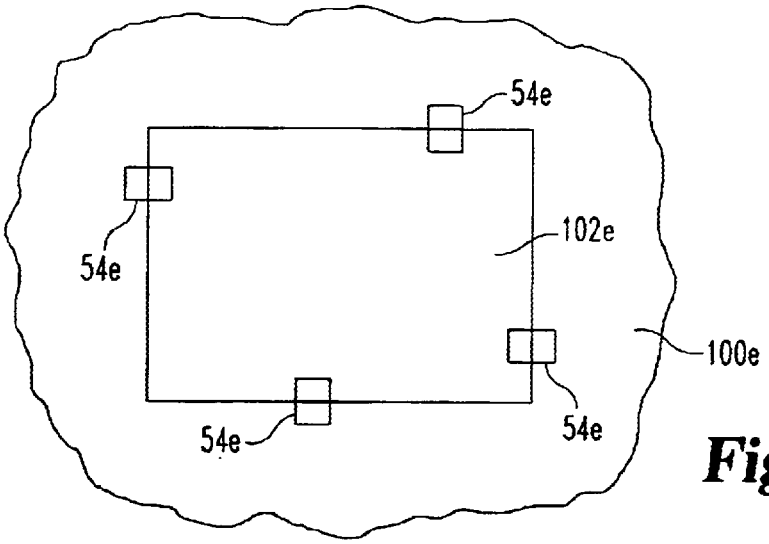
Fig. 10
Fig. 11
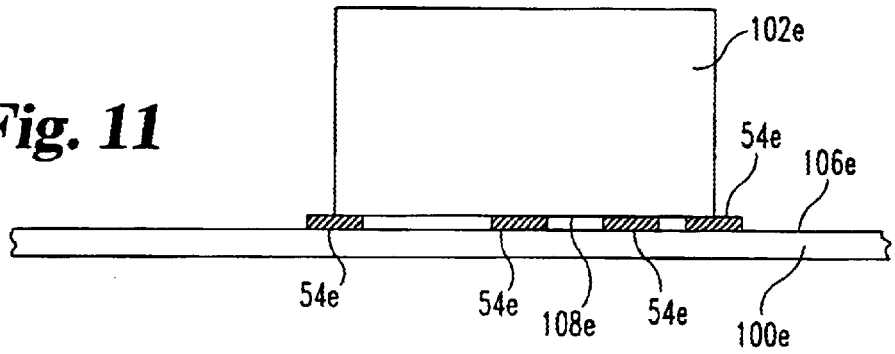
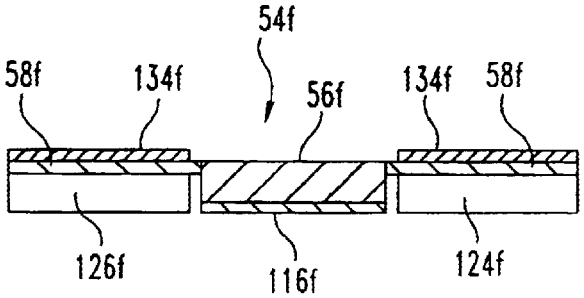
Fig. 12

RADIO FREQUENCY SECURITY SYSTEM AND METHOD FOR A BUILDING FACILITY

BACKGROUND OF THE INVENTION

The present invention relates to a system, method and apparatus for maintaining security, and more particularly for maintaining security in an environment such as a building facility where there is a security-sensitive area with security-sensitive objects or items. The system is designed to respond to security risk occurrences, such as a possible covert entry, movement of components of the building facility and/or theft and/or movement of security-sensitive items or objects.

BACKGROUND OF THE INVENTION

A significant challenge in both government and industry is maintaining security in security-sensitive areas, such as in a building facility, where various items and objects and/or items of value are present. In order to maintain such security, it is quite common for security people to go through the security-sensitive areas to look for situations, items or evidence of a potential security risk. In some instances, the security people would be looking for any evidence of an unauthorized entry into the secured area. In other instances, the security people would find security-sensitive items left out in the open, instead of being locked in a secured location, such as a safe, vault or file cabinets.

By way of example, in many building facilities there are security-sensitive areas where the surrounding walls are not true floor to ceiling walls, but extend only partially toward the true ceiling. Then there is a false ceiling made up of ceiling tiles which are supported by metal support member (beams) that extend in a horizontal grid-like pattern over the ceiling area at a location spaced downwardly from the true ceiling. In these instances, it is a common practice to use, for example, tile clips that are installed in the ceiling system. When any of these ceiling tile clips are disturbed visual inspection will indicate that this disturbance has occurred, thus indicating the possibility of a covert intrusion. Both the installation of the ceiling clips and the regular visual inspection are costly.

There are other situations where components or objects that are part of the building structure or building facility could be tampered with in some way, such as being moved from their normal location. This could occur where there is a theft of various items or objects which are security-sensitive. Some of these objects or items themselves contain security-sensitive information or are of sufficient value so as to be security-sensitive. Other objects are containers (even large containers) that have security-sensitive items therein.

The system, method and apparatus of the present invention is designed to provide an effective means of alleviating as much as possible such security risks.

SUMMARY OF THE INVENTION

The method of the present invention is arranged to reduce security risks in or adjacent to a building facility where there are in, or proximate to, the building facility components which comprise one or more of the following:

a) building component(s) which are part of, or associated with, a building of the building facility;

b) facility component(s) which are in or adjacent to the building and relate to functions or occupancy of the building facility;

c) other component(s) which are in or adjacent to the building facility that are not included in building components or facility components.

Each of these components are further categorized as follows:

a) security-sensitive components which comprise:
   i. component(s) which themselves are security-sensitive (i.e. because of having or containing security-sensitive information or items or components which are of sufficient value to be security-sensitive);
   ii. component(s) which are of a nature that if moved or otherwise tampered with in some manner such tampering may indicate a security risk;
   iii. components which are both themselves security-sensitive and also are of a nature that if moved or otherwise tampered with in some manner such tampering may indicate a security risk;

b) non-security-sensitive component(s), which include the items or components which are not security-sensitive.

The method of the present invention comprises providing at least one tamper-indicating device which in turn comprises a tamper-responsive section which comprises at least one tamper-responsive portion which has an intact condition and a non-intact condition. In a preferred form of the present invention, this tamper-responsive portion has an electrically conductive portion which in the intact position is able to conduct electricity between first and second tamper related locations, and in the non-intact position is not able to conduct electricity between the first and second tamper related locations.

Also, the tamper-indicating device comprises a signaling section that is operatively connected to the tamper-responsive section in a manner to:

a) provide a signal indicating at least one of;
   i. a non-intact condition;
   ii. an intact condition; or b) not provide a signal in response to an interrogating signal to indicate:
   i. a non-intact condition; or
   ii. an intact condition The tamper-indicating device is placed in a security risk detecting position by operatively engaging the tamper-indicating device to two of said components, at least one of which is a security-sensitive component. The two components are characterized in that relative movements between the two components indicates a possibility of a security risk occurrence. The tamper-indicating device is arranged and connected to the two components so that relative movement between the two components causes a break or damage to the tamper-responsive section to cause the tamper-responsive section to go to its non-intact condition.

Then a signal receiving device is operated to ascertain either a reception of a signal or a lack of reception of a signal from the tamper-indicating device to ascertain the possible security risk occurrence. In some embodiments of the present invention, the tamper-indicating device transmits its tamper-indicating signal in response to the tamper-responsive section going to its non-intact condition. The tamper-indicating device has a sleep mode which exists so long as the tamper-responsive section is in its intact position. The tamper-indicating device is caused to go from the sleep mode to an active mode upon occurrence of the tamper-responsive section going to its non-intact condition to in turn to cause the tamper-signaling section to transmit the tamper-indicating signal. In the preferred embodiment the electrically conductive portion in the intact position causes the tamper-indicating device to remain in its sleep mode and in the non-intact position causes the tamper-indicating device to go to its active mode.

In a preferred form, the electrically conductive portion is operatively connected to circuitry of the tamper-signaling section in a manner that with the electrically conductive portion in its intact position, an input to a micro-controller of said tamper-signaling section is at a first voltage level. Then with the electrically conductive portion in its non-intact position, the input to the micro-controller is at another voltage level, with the change from the first voltage level causes the micro-controller to place the tamper-signaling section into its active mode.

In another embodiment of the present invention, interrogating signals are transmitted to the tamper-indicating device, and the tamper-indicating device modulates the signal in response to the interrogating signal so that a modulated response is transmitted when there is an intact condition of the tamper-responsive section. When a non-intact condition exists, the modulated signal is not transmitted, thus indicating a possibility of a security risk.

Also in a preferred embodiment, the tamper-indicating device with the tamper-responsive section in its intact position is energized by an interrogating signal to provide a modulated response. With the tamper-responsive section in its non-intact position, the tamper-responsive device does not send the modulated response. In a specific form, the electrically conductive portion of the tamper-indicating device is operatively connected into circuitry of the tamper-signaling section so that when the tamper-signaling section is conductive, energizing current from the interrogating signal is able to cause the modulated response to the interrogating signal.

In a preferred form of the present invention the tamper-signaling section comprises operating components which are positioned within a housing of the tamper-signaling section. The operating components are responsive to the tamper-responsive section to produce the tamper-indicating signal. The tamper-responsive section comprises a plurality of tamper-responsive portions which are operatively connected to the tamper-signaling section in a manner that the signal transmitting section responds to any one of these tamper-responsive portions being in its intact or non-intact condition.

In a specific application of the present invention, a first connecting portion of the tamper-indicating device is connected to one of the two components, and a second connecting portion of the tamper-indicating device is connected to the other of the two components, with a tamper-responsive region of the tamper-responsive section being between the connecting portions in a manner that relative movement of the two components causes the tamper-responsive region to become severed or damaged to make the electrically conductive portion become non-conductive.

In one arrangement the two components having facing surfaces adjacent to one another, and the tamper-indicating device is positioned between the two facing surfaces. The first connecting portion of the tamper-indicating device is connected to one of the two components and the second connecting portion is connected to the other of the components in a manner that relative movement of the two components moves the two facing surfaces apart to cause a break or damage to the electrically conductive portion.

In another arrangement, there is a plurality of these tamper-indicating devices positioned between the two facing surfaces and connected to the facing surfaces, and the tamper-indicating devices are arranged so as to be positioned inwardly from surrounding edge portions of the surfaces so that relative rotational movement of the components to rotate the facing surfaces away from one another causes at least one of the tamper-indicating devices to go to its non-intact position. In another arrangement the first and second connecting portions of the tamper-indicating device are located on the tamper-responsive section, and the tamper-responsive section is connected to surface of the two components which are in general alignment with one another and spaced from one another.

Other features of the present invention will become apparent from the following detailed description.

BRIEF DESCRIPTION OF THE DRAWINGS

FIG. 2 is a semi-schematic plan view of a portion of a false ceiling where there are ceiling tiles supported by a plurality of support members, with the tamper-indicating device of a first embodiment of the present invention shown in its installed position;

FIG. 3 is a plan view, as in FIG. 2, showing somewhat schematically one of the tamper-indicating devices of the present invention, having two tendrils;

FIG. 4 is a view similar to FIG. 3, showing a tamper-indicating device having four tendrils and being positioned at the juncture of corner portions of four adjacent ceiling tiles;

FIG. 10 is a plan view showing three of the tamper-indicating devices of FIG. 9 positioned at the bottom surface of a security-sensitive object;

FIG. 11 is a side elevational view of the arrangement of FIG. 10, showing the three tamper-indicating devices positioned between the security-sensitive object and a support member, such as a table top;

FIG. 12 is a side elevational, partly in section, showing yet a seventh embodiment of the present invention;

DESCRIPTION OF THE PREFERRED EMBODIMENTS

Figure 1:
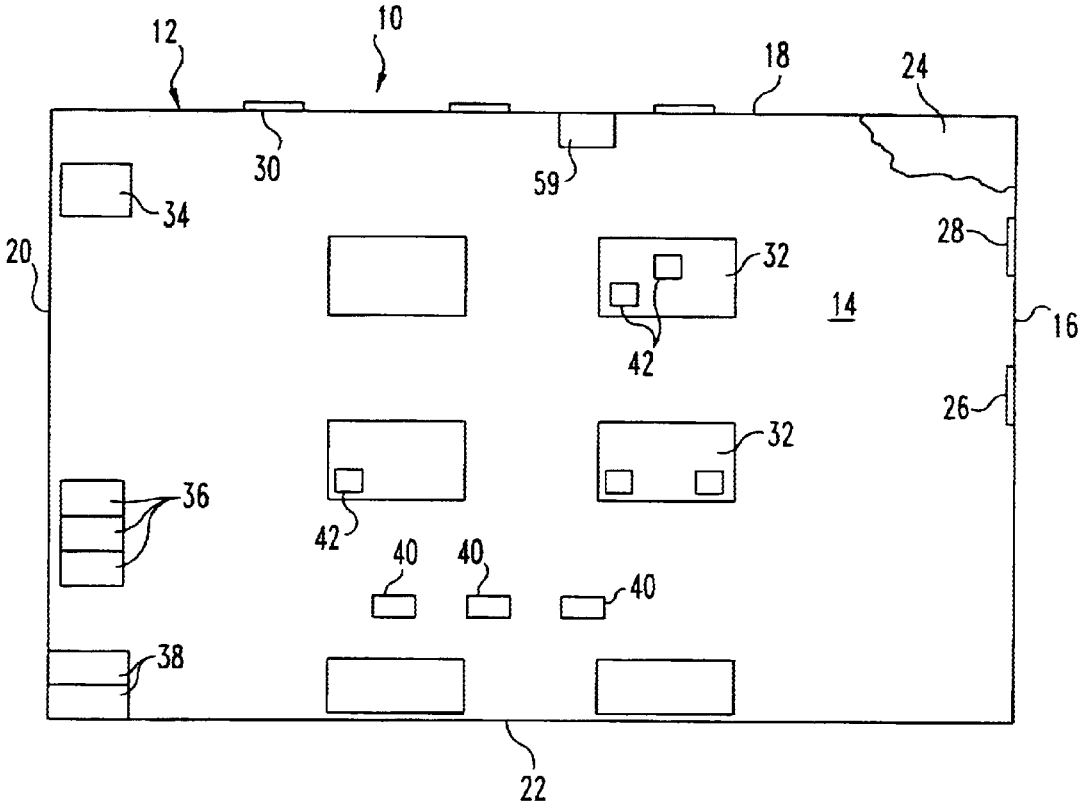
FIG. 1 is a schematic plan view of a building facility in which the system, apparatus and method of the present invention is incorporated.

In FIG. 1, there is illustrated by way of example, an environment in which the system of the present invention could be used advantageously. FIG. 1 shows schematically a building facility 10 which comprises a building structure 12 defining a secured area 13. The structure 12 comprises a floor 14, four sidewalls 16, 18, 20 and 22, and a ceiling (a portion of which is indicated at 24). The sidewall 16 has a doorway (exitlentrance) 26 for ingress and egress to and from the security-sensitive area 13 and an emergency exit doorway 28. The wall 18 has three windows 30 leading to an outside location.

Within the secured area 13, are a number of desks 32 which would normally be used by the personnel in the secured area 13 during working hours. By way of example, there is a locked safe 34 (or vault), three locked file cabinets 36 and two unlocked file cabinets 38, which are positioned adjacent against the wall 20. There is also shown somewhat schematically several security-sensitive items generally designated 40, and these would be various movable items which would quite commonly be in a security-sensitive area. These could include documents, written communications, computer hard drives, discs, and other computer information media, funds and currency, items which contain evidence or evidentiary data, high valued items, etc. However, in the non-working periods during which the security-sensitive area may not have any people therein, these security-sensitive items 40 will be placed either in the safe 34, one of the locked file cabinets 36 or some other secure location.

At this point it would be helpful for a more complete understanding of the present invention to indicate that the present invention can be combined with or incorporated with one or more other security systems. One such security system is described in the recently filed U.S. patent application, entitled "Radio Frequency Personnel Alerting Security System and Method", filed Jun. 19, 2001, having as the inventors the same inventors which are the applicants in the present invention. This other security system is particularly adapted for maintaining the security of the moveable security-sensitive items 40, as indicated above. Later in the present text this other security system will be summarized and it will be indicated how the two systems could be used in combination. Thus, the contents of this other above mentioned patent application are incorporated herein by reference.

To continue now with the description of the present invention, reference is again made to FIG. 1. There are the other objects or components indicated at 42, which are also security-sensitive either because of the information they contain or possibly for some other reason, such as being a rather expensive item which should be protected from theft. These could be, for example, computer related equipment, or a locked container which is used to contain security-sensitive documents and which for convenience is placed on a person's desk. These objects 42 are characterized in that either for reasons of size, or convenience, it is not practical (or desirable) to place these in a secured location, such as a safe 34 or the locked file cabinet 36.

Also, these objects 42 could be such things as the safe 34 and the locked file cabinet 36. Even though these are securely locked, they could be susceptible to security risks by someone simply removing the entire safe 34 or locked file cabinet 36 from the security-sensitive premises. Then these could be opened at some other location to remove the security-sensitive documents. Also, there are other security problems, such as unauthorized personnel making a covert entry through the building structure into the secured area. The present invention relates to maintaining security for these sorts of items and situations.

With the above being given as further background information, there will now be described the various embodiments of the present invention.

A first embodiment of the present invention will now be described with reference to FIGS. 1–5. As indicated previously in the introductory portion of this text under the subject heading "Background Art", there is one type of security problem where there is a security-sensitive area where the surrounding walls are not true floor to true ceiling walls, but extend only partially toward the true ceiling. Then there is a false ceiling made up of ceiling tiles which are supported by metal support members (beams) that extend in a grid-like pattern over the ceiling area at a location spaced downwardly from the true ceiling. Also (as indicated earlier in this text), in the prior art where that area with the false ceiling tiles is security-sensitive, in many instances the use of ceiling tile clips is required to be installed in the ceiling system. Then when any of these ceiling tile clips are disturbed (for example by a person moving or removing one of the ceiling tiles), visual inspection will indicate that this disturbance has occurred, thus indicating the possible occurrence of a covert intrusion. Both the initial installation of the ceiling tile clips and the regular visual inspection are costly. Also, if a covert intrusion has occurred, it may be many hours later that the visual inspection is made. This first embodiment is designed to alleviate this problem.

To describe now this first embodiment reference is first made to FIG. 2 which shows a portion of the aforementioned false ceiling 24, and specifically there is shown in FIG. 2 four of the individual ceiling tiles 46 supported by the support members formed in a rectangular grid pattern, these support members being indicated schematically at 48. Depending upon the size of the area of the false ceiling 24, there could be as many as several hundred tiles 46. These are arranged in a rectangular grid pattern, and the four tiles 46 that are shown in FIG. 2 are arranged in such a configuration, so that there is a juncture location 50 at which four adjacent corners 52 of the tiles 46 meet are closely adjacent to one another.

In accordance with the present invention, there is located at each of these juncture locations 50 a tamper-indicating device 54. This device 54 incorporates basic RFID technology, and in this particular embodiment comprises an operating or transmitting section 55 which comprises a containing housing 56, and a tamper-indicating section 57 which in this particular arrangement shown in FIG. 2 (and also shown in FIG. 4) comprises four elongate fingers or tendrils 58 which are operatively connected to the transmitting section 55. As shown herein, these four tendrils extend outwardly from the housing 56, with these tendrils 58 being oriented at right angles to one another. As can be seen in FIG. 2, each of these tendrils 58 reaches outwardly to extend over the corner portion 52 of a related ceiling tile 46. Each tendril 58 is bonded or otherwise secured to its related ceiling tile 46. If one of these ceiling tiles 46 is moved, as will be described later herein the tendril 58 (which is attached to that tile 46) would break or otherwise be damaged so as to cause a separation or break of a frangible wire of the tendril 58.

When one of the tendrils 58 is so damaged, this causes the tamper-indicating device 54 to transmit an electromagnetic alarm signal (desirably an RFID signal which would identify that particular tamper-indicating device) to a suitable receiver/monitor indicated schematically at 59, which in turn provides a signal to cause remedial action to be taken (see FIG. 1). Such action quite likely would be an on site investigation at the location of signal producing RF tamper-indicating device or devices 54 to see if a covert intrusion has been made into the secured area.

In FIG. 4, there is shown an RF tamper-indicating device 54 which has four such tendrils 58, and in FIG. 3, there is shown another RF tamper-indicating device 60 having an operating section 61 with two tendrils 62 extending oppositely from one another. It can be seen in FIG. 2 that this RF tamper-indicating device 60 is used at a location where there are only two adjacent ceiling tiles 46.

The tamper-indicating device 54 and 60 can be considered as a specialized form of an RFID tag. Accordingly, in the following text, for convenience, the tamper-indicating device will often be referred to as a "tag", "RF tag", or "RFID tag".

While the first embodiment of the present invention has been described only with reference to the ceiling tiles 46, it is to be understood that it could be applied to other components of the building structure 12. For example, the windows 30 may be of a nature that these are seldom opened (or opened not at all), and yet these would present possible opportunities for a covert entry. The radio frequency tamper-indicating device 54 or 60 could be used with these in generally the same manner as indicated above. Also, there may be structural panels or components which are joined together to form, for example, the walls or ceiling portions of some other design, and the radio frequency tags or members 54 and/or 60 could be used to provide security at those locations also.

Figure 5:
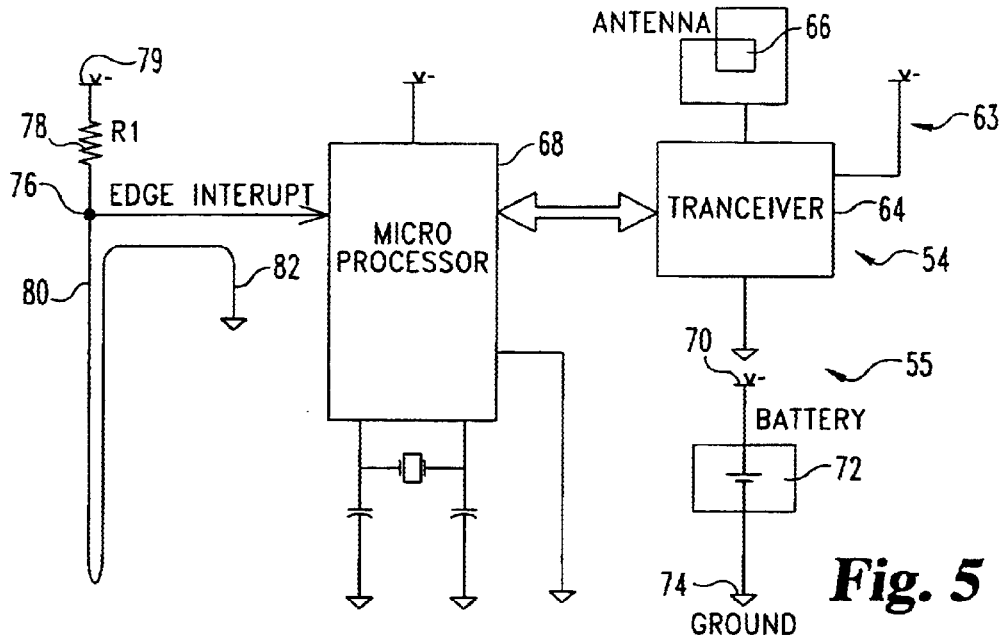
FIG. 5 is a schematic view showing the main components and circuitry of a first embodiment of the present invention.

To describe the components of the operating section 55 of the RF tag 54 or 60, reference is made to FIG. 5. In the text which follows, since the operating components of the tags 54 and 60 are identical (or substantially identical), reference will be made only to the tag 54 with the understanding that the description refers as well to the tag 60. These operating components are collectively designated as a signal generating apparatus, which is identified by the numeral 63. This apparatus 63 comprises a transceiver 64 that is operatively connected to an antenna 66. The transceiver 64 has the capability to transmit through the antenna 66 an electromagnetic signal to the receiver monitor 59 (see FIG. 1).

The transceiver 64 is also operatively connected to a micro-controller 68 (i.e. a microprocessor), such as the Texas Instruments MSP430 series, and has an operative connection at 70 to a battery 72 which in turn is connected to ground at 74. Any conventional transceiver 64 can be used as long as it is compatible with the micro-controller 68 and can be activated by a signal from the micro-controller 68. The micro-controller 68 is normally in a very low power "sleep mode" until activated. To activate the micro-controller 68 there is provided a connection at 76 to a resistor 78 that is in turn connected to a positive voltage terminal 79 from the battery 72. The connection at 76 also connects to the aforementioned frangible wire of the tendril 58. This frangible wire is indicated herein at 80 and (as indicated previously) is part of its related tendril 58. The other end of the frangible wire connects to a ground at 82. In this particular embodiment, the frangible wire 80 extends in an elongate loop, and the connections at 76 and 82 are adjacent to the RF tag housing 56. The resistance level of the wire 80 is relatively low and the resistance level of the resistor 78 is relatively high. Accordingly, in the sleep mode very little current flows through the resistor 78, and the voltage at the connection 76 is essentially at ground.

To describe now the operation of the RF tag 54, as indicated above, the micro-controller (micro-controller) 68 is normally in the low power sleep mode. When a security breach breaks the frangible wire 80 in the tendril 58, this causes the connection at 76 to swing from a low voltage state to the voltage at the terminal 79 through the resister 78. This state causes an edge triggered interrupt within the micro-controller (micro-controller) 68, and the micro-controller in turn powers up from its sleep state and activates the transceiver 64 (functioning as a transmitter). The transceiver 64 then sends a signal through the antenna 66 to the receiver/monitor 59. This signal which is sent to the receiver/monitor 59 gives the message that "I am damaged; my wire 80 has been broken or disconnected".

This particular type of RFID tag (tamper-indicating device) 54 described in reference to FIG. 5 is constructed so that in the sleep mode almost no charge is required to maintain the alert condition of the device 54, and the device 54 could be operational in its sleep mode, for as long as possibly two years or more. At that time, another battery could be installed, or assuming the cost of the RF tag 54 is sufficiently low cost, a new tag 54 could be installed.

Alternatively, this system could be arranged so that the tamper-indicating devices 54 and 60 would be made as passive RFID tags where the tag 54 or 60 would not have a power source as a battery 72, and the power of an interrogation signal would be sufficient to generate the response as needed from the tag 54 or 60. In this instance the tags 54 and 60 would likely be arranged so that when interrogated, when the tag 54 or 60 is intact (i.e. the wire 80 is not broken), the tag 54 or 60 would give an "I'm okay" response. On the other hand, when the tag 54 or 60 is interrogated and no response is received, then this lack of a response would be interpreted as indicating that the tag 54 and 60 is inoperative (which would usually mean that the wire 80 is broken or damaged.

Figure 5A:
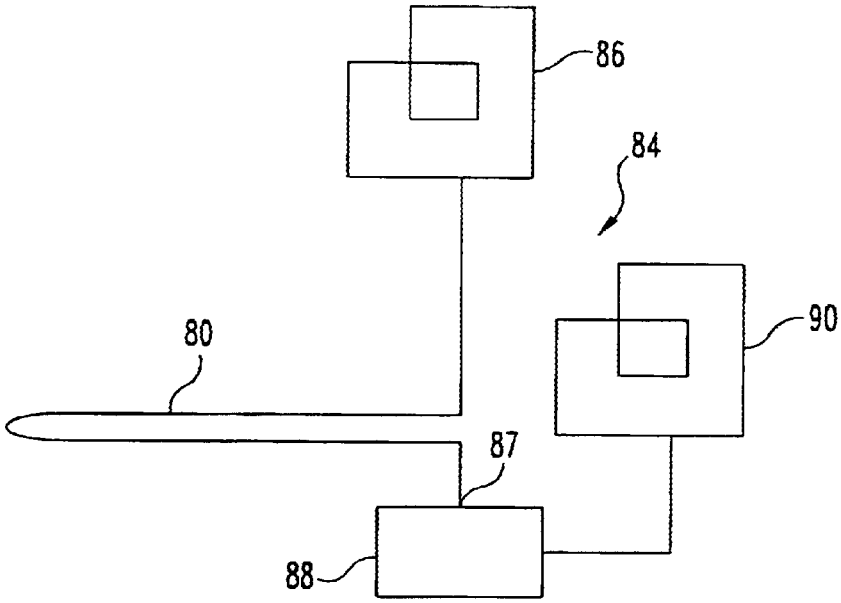
FIGS. 5A and 5B are each a schematic drawing of a passive tamper-indicating device similar to that shown in FIG. 5.

The tamper detecting device 84 by which this could be accomplished is shown schematically in FIG. 5A. There is a receiving antenna 86, operatively connected to one end of the wire loop 80, with the other end of the loop 80 being connected to an input 87 of the operating circuitry 88 which would include the micro-controller and other related components. The output of the operating section 88 connects to a transmitting antenna 90 from which the modulated return signal is directed back to the interrogating/receiving location or simply back to one or more receiving locations. The operating section 88 would be activated by the energy that the receiving antenna 86 absorbs from the interrogating signal and modulates this in a manner that the modulated signal would travel from the transmitting antenna 90 back to the receiving location.

In operation, when the wire 80 is intact, the interrogating signals would generate a modulated response that would be received as an "I'm okay" signal. Since the modulated response identifies that particular tag 54, this response will be interpreted as coming from a particular tag location. On the other hand, when the wire 80 is broken, the power from the interrogating signal is not transmitted from the receiving antenna and no response is generated from the operating section 88. Thus, the transceiver/monitoring apparatus would recognize that no response was given to that interrogated signal and this would indicate that the wire 80 at this particular tag was broken, and thus indicating a possible security risk occurrence.

Figure 5B:
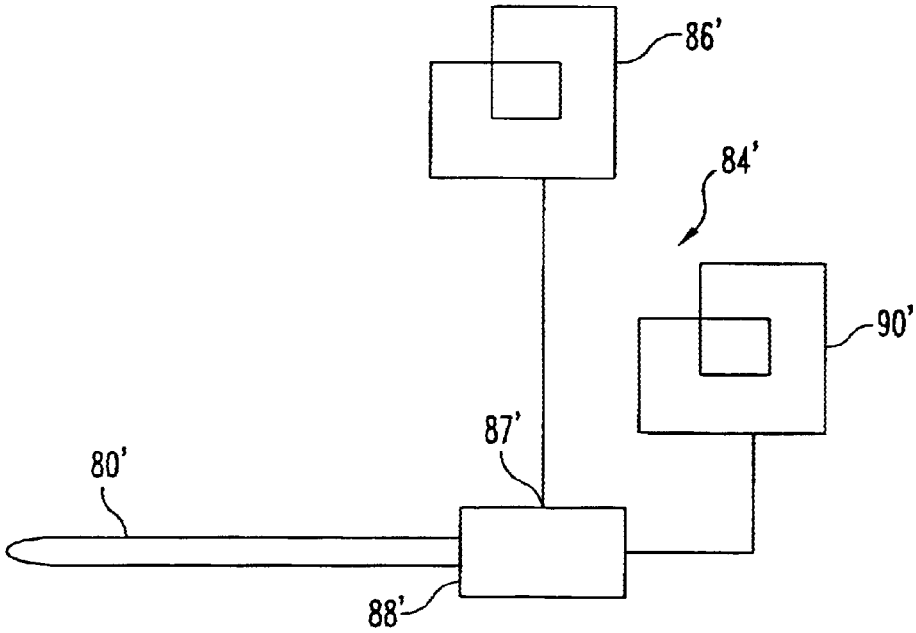

A modified version of the device is shown in FIG. 5B. The components of the device shown in FIG. 5B which are the same as or similar to components of the tamper-indicating device 84, FIG. 5A, will be given light numerical designation with a (') designation distinguishing those of this modified version of FIG. 5B. The tamper-indicating device 84' of FIG. 5B and comprises the same antennas 86' and 90', the circuitry 88', and the wire loop 80'. However, the wire loop 80' is not connected in series between the antenna 86 prim and the circuitry 88'. Rather, the wire loop is connected to the circuitry 88' and its intact and non-intact configurations are detected in the manner described previously herein relative to the embodiment shown in FIG. 5. Also, the receiving antenna 86' has a direct connection at 87' to the circuitry 88'. The return signal from the circuitry 88' is, as in the circuitry of FIG. 5A, transmitted to the transmitting antenna 90'.

Within the broader scope of the present invention, there could be a number of variations. Three of these are shown as additional embodiments in FIGS. 6A, 6B and 6C.

Figure 6A:
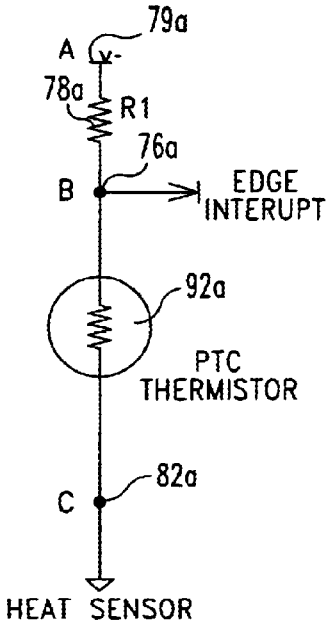
FIGS. 6A, 6B and 6C are schematic views of second, third and fourth embodiments having other arrangements of a tamper-indicating device which would be useable in broader applications of the present invention.

Initially the second embodiment shown in FIG. 6A will be described. In describing this second embodiment, components of the second embodiment which are essentially the same as (or similar to) components of the first embodiment will be given like numerical designations, with a "a" suffix distinguishing those of the second embodiment. The tag 54*a* in the embodiment of FIG. 6A is the same as shown in FIG. 5, in that there is the transceiver 64, the antenna 66, the micro-controller 68, and the battery 72, as shown in FIG. 5. Accordingly, only those components of the second embodiment shown which function somewhat differently or are in a somewhat different arrangement are illustrated in 6A.

In FIG. 6A, there is the connection 76*a* to the micro-controller (68 in FIG. 5), and there is also the voltage source 79*a* which connects to the connection 76*a* through the high resistance resistor 78*a*. However, instead of having the frangible wire 80, there is provided a thermistor 92*a* connected to the connection 76*a* and to the ground connection 82*a*. This thermistor 92*a* normally is conductive, but if the ambient temperature rises above a predetermined level, the electrical resistance increases. Accordingly, this will initiate a signal to the micro-controller 68 which will in turn transmit an alarm signal that there is a high temperature condition at the thermistor 92*a*, this high temperature condition possibly resulting from a fire.

Figure 6B:
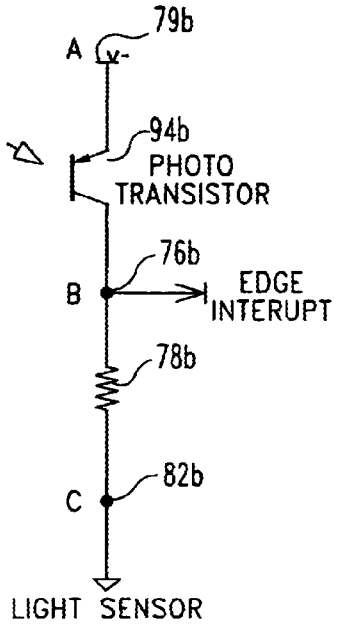

In FIG. 6B, there is shown a third embodiment, and as in the description relative to the embodiment of FIG. 6A, the components of this third embodiment which correspond to components in the first and/or second embodiments will be given like numerical designations, but with a "b" suffix distinguishing those of the third embodiment.

This RF tag 54*b* of the third embodiment is somewhat similar to the second embodiment of FIG. 6A, but it differs in that the resistor 78*b* is connected between the connecting points 76*b* and 82*b*. Then there is located between the voltage source 79*b* and the connection 76*b* a phototransistor 94*b*. The phototransistor 94*b* is normally nonconductive, but when a light is shone upon the phototransistor 94*b*, it then becomes conductive. Accordingly, it can be seen that in normal operation (when there is no light directed to the phototransistor 94*b*) the contact 76*b* will be at ground potential. Then when the phototransistor 94*b* becomes conductive, thus forming a conductive path from the points 79*b* to 76*b*, this activates the micro-controller to cause the alarm signal to be generated. For example, this RF tag could be located in a dark room, and if an anomalous light source is detected, this would create an alarm signal.

This third embodiment could be used in a variety of situations, and these are discussed further later in this text. However, to give one example at this time, the light sensitive surface of the photoresister could normally be covered by an opaque cover in an environment where there is light. The security intrusion or movement of security-sensitive item would result in the opaque cover being removed from the light sensitive surface, thus triggering an alarm.

Figure 6C:
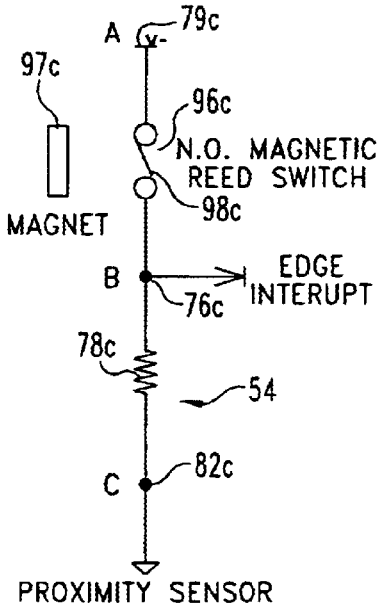

FIG. 6C shows a fourth embodiment, and components of this fourth embodiment which are similar to prior embodiments will be given like numerical designations with a "c" suffix distinguishing those in the fourth embodiment. This RF tag 54*c* of the fourth embodiment is substantially the same as the third embodiment of FIG. 6B, except that in place of the photo transistor 94*b*, there is provided a magnetic reed switch 96*c* which is normally open. Then when the switch 96*c* comes in proximity to a source 97*c* of a magnetic field, then the switch element 98*c* closes. An application of this embodiment (in a somewhat modified form) will be described later herein.

Figure 7:
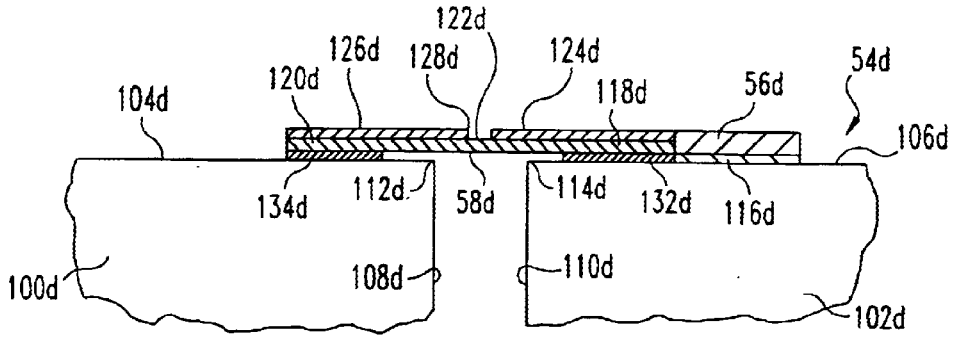
FIG. 7 is a side elevational view, partly in section, showing a fifth embodiment of the tamper-indicating device.
Figure 8:
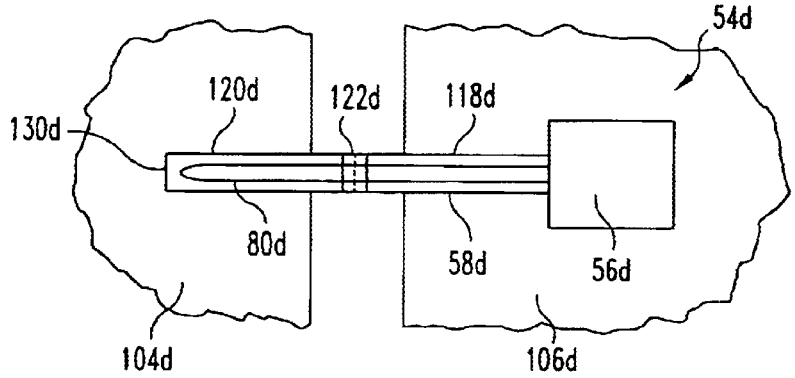
FIG. 8 is a plan view of the tamper-indicating device of FIG. 7.

Reference is now made to FIGS. 7 and 8 which show a fifth embodiment. In describing this fifth embodiment of FIGS. 7 and 8, components which are similar to corresponding components in one or more of the prior embodiments will be given a like numerical designation or designations, with a "d" suffix distinguishing those of the fifth embodiment.

FIG. 7 is a side elevational view where there are shown two objects 100*d* and 102*d*, with these having first parallel and aligned surfaces 104*d* and 106*d*, respectively, aligned in a common plane, and two other parallel surfaces 108*d* and 110*d* which face one another and are spaced laterally from one another, with the surfaces 104*d* and 108*d* being at right angles to one another and meeting at a corner edge 112*d*, and the surfaces 106*d* and 110*d* also being at right angles to one another and meeting at an edge location 114*d*. These two objects 100*d* and 102*d* could be two building structural components which are adjacent to one another, or the object 100*d* could be stationary structure, and the object 102*d* could be a security-sensitive container or some other security-sensitive object which is moveable and adjacent to the stationary structure 100*d*. Or these two members or components 100*d* and 102*d* could be two moveable objects which in a normal configuration would be adjacent to, or at least contiguous to, one another, but or of such a nature that when one of these is moved relative to the other, this would indicate an occurrence that may relate to a security risk.

With further reference to FIGS. 7 and 8, the radio frequency tag or member 54*d* comprises a housing 56*d* containing the operating components and one arm or extension member 58*d* which is comparable to the tendril extension member 58. The housing 56*d* has at its bottom surface an adhesive coating 116*d*, by which the housing 56*d* can be securely bonded to the surface 106*d*. The tendril or arm 58*d* has two portions, namely a first portion 118*d* which is directly connected into the housing 56*d*, and a second portion 120*d* which is at the outward end of the tendril 58*d* (i.e. further from the housing 56*d*). The two tendril portions 118*d* and 120*d* are joined to one another along a serrated or otherwise weakened juncture line or location 122*d* so that the two sections 118*d* and 120*d* can be more easily separated from one another at the location 122*d*.

There are provided a pair of stiffening plates, 124*d* and 126*d*. The stiffening plate 124*d* is fixedly connected (e.g. by bonding) to the tendril portion 118*d*, and the other stiffening plate 126*d* is fixedly attached (e.g. bonded) to the tendril portion 120*d*. These two plates 124*d* and 126*d* have adjacent edges 128*d* which are positioned closely to one another on opposite sides of the serrated or weakened location 122*d*.

In the plan view of FIG. 8, it can be seen that the tendril 58*d* comprises the wire loop 80*d* embedded into a rather thin elongate strip of material 130*d*. This could be plastic material or a plastic/fabric material could be similar to a piece of adhesive tape. The lower surface of the two tendril portions 124*d* and 126*d* each have an adhesive layer 132*d* and 134*d*, respectively, by which the tendril portions 126*d* and 124*d* are bonded to their respective upper surfaces 106*d* and 104*d*.

To describe the operation of this fifth embodiment of FIGS. 7 and 8, it should first be noted that the two rigid plates 124*d* and 126*d* are each bonded to their respective tendril portions 118*d* and 120*d* that are in turn bonded to the surfaces 106*d* and 104*d* of the objects 102*d* and 100*d* so that two rigid plates 124*d* and 126*d* and the tendril portions 118*d* and 120*d* are fixedly connected to their respective objects 100*d* and 102*d*. Thus, when there is even a slight relative movement between the two objects 100*d* and 102*d*, there will be a break occurring along the serrated location 122*d* of the tendril 58*d*.

Figure 9:
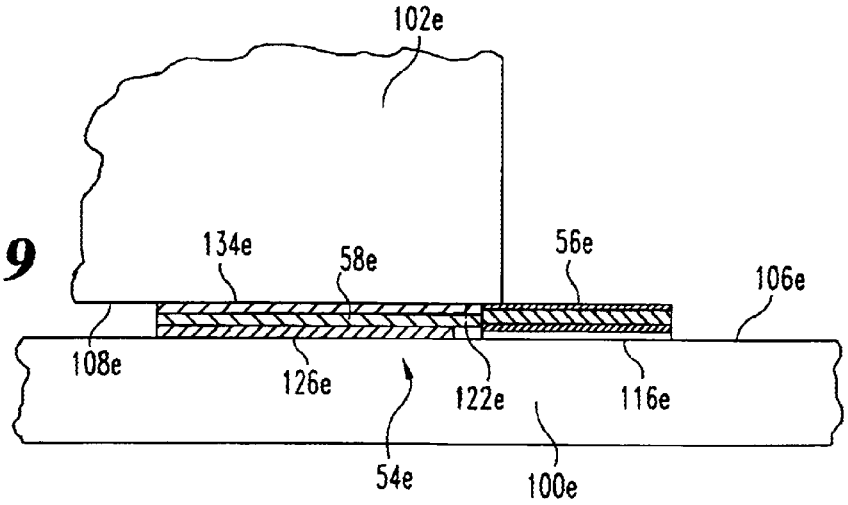
FIG. 9 is a side elevational view, partly in section, similar to FIG. 7, showing a sixth embodiment of the present invention.

To describe now the sixth embodiment of the present invention, shown in FIG. 9. As with the prior embodiments, components which are similar to the components of the prior embodiments will be given like numerical designations, with an "e" suffix distinguishing those of this sixth embodiment.

In FIG. 9 the RF tag or member 54*e* is positioned between two objects 100*e* and 102*e*, having facing flat surfaces 106*e* and 108*e* which are closely adjacent to one another, with only the thickness of the RF tag 54*e* separating the two surfaces 106*e* and 108*e*. The object 100*e* could be, for example, a table top or a counter top, and the object 102*e*, could be, for example, a security-sensitive item such as a piece of computer equipment, or possibly a locked container which itself contains security-sensitive items.

This RF tag 54*d* has a housing 56*e* and a single tendril 58*e*. The overall configuration of this tag 56*e* can be the same as, or substantially the same as the tag 54*d* of the fifth embodiment.

The housing 56*e* is for the most part located adjacent to, but spaced laterally from, the object 102*e* so that its antenna is not shielded by the object 102*e*. The housing 56*e* has on its lower surface an adhesive layer 116*e* so as to be bonded to the surface 106*e*, and the upper surface of the tendril 58*e* has an upper adhesive surface 134*e* so as to be bonded to the surface 108*e*. In addition, the tendril 58*e* has bonded to its lower surface a rigid plate member 126*e*. There is a serrated or weakened portion 122*e* in the tendril 58*e* at a location closely adjacent to the housing 56*e*.

To describe the operation of this sixth embodiment, reference is now made to FIGS. 10 and 11. Let us assume (as suggested earlier) that the lower member 100*e* is a table top and the object 102*e* is a piece of a computer equipment which is security-sensitive. Further, it is expected that the piece of computer equipment 102*e* is to remain at a stationary location on the table top 100*e* for an extended length of time. To accomplish this, a plurality of the RF tags 54*e* are placed at spaced locations along the bottom surface 108*e* of the object (e.g. computer equipment) 102*e*, so that the top adhesive layer 134 sticks to the lower surface 108*e* of the computer equipment 102*e*. Then the piece of computer equipment 102*e* is placed on the top surface 106*e* of the table top 100*e* so that the bottom adhesive surfaces 116*e* of each of the housing portions 56*e* of the three RF tags 54*e* adheres to the upper surface 106*e* of the table top 100*e*. The adhesive layer 116*e* and 134*e* could initially be covered by a removable protective layer.

Now let us assume that someone wishes to remove this piece of computer equipment 102*e* from its position on top of the table 100*e*. Obviously, if the person simply lifts the computer equipment 102*e* from the table, each of the housing sections 56*e* of the three tags 54*e* will adhere to the upper surface 106*e* of the table top 100*e*, and the tendril sections 58*e* of each of the tags 54*e* will adhere to the piece of computer equipment 102*e*. This will cause the wire loop 80 and each of the tendrils 58*e* to break, with the RF tags 54*e* giving the alarm signal.

Now let us take the situation where the thief is aware of the use of the RF tags, and the thief attempts to somehow sever the adhesive layers 116 that adhere to the surface 106*e* or possibly the adhesive layers of the tendril portions 58*e* that adhere to the bottom surface of the computer equipment 102*e*. Let us further assume that this person is successful of slipping a very thin severing tool underneath the computer equipment 102*e*. It is likely that this attempt to sever, for example, the RF tag 54*e* on the right side of FIG. 11 will raise the right side of the computer equipment 102*e* at least a short distance. This would cause the computer equipment 102*e* to rotate at least slightly about the left RF tag 54*e* so as to tend to raise at least one of the other RF tags 54*e* slightly above the surface 106*e*. The effect of this would be to separate the housing 56*e* from the tendril portion 58*e* along the severance line 122*e*, thus causing the alarm signal to be given.

A seventh embodiment of the present invention is shown in FIG. 12. As in the description of the other embodiments, components of earlier embodiment will be given like numerical designation with the "f" distinguishing those of this seventh embodiment.

An examination of FIG. 12 will indicate that the RF tag 54*f* of this seventh embodiment is very similar to the fifth embodiment, except instead of having a single tendril section 58*e*, there are two oppositely extending tendril sections 58*f*.

Thus, there is the central housing section 56*f* and the two aforementioned tendril section 58*f* on opposite sides thereof. There is a top adhesive layer 134*f* over the top surface of each of the tendril sections 58*f*. Also, the lower surface of the housing 56*f* has an adhesive layer 116*f*.

Also, there are two rigid plates 124*f* and 126*f* bonded to the related tendril members 58*f* so that the lower surface of these two rigid plates 124*f* and 126*f* are in the same plane as the lower adhesive layer at 116*f* of the housing 156*f*.

The operation of this seventh embodiment of FIG. 12 is similar to the operation of the sixth embodiment of FIGS. 9–11. The particular application of this seventh embodiment could be used in other ways. For example, the two tendril sections 58*f* could be positioned beneath adjacent objects, so that either of the objects connected to their respective tendril sections 58*f* would activate the operating section contained in the housing 56*f*. Also, it may be that the object in which the tamper-indicating device 54 is attached has a somewhat different configuration where there are two side sections (e.g. where there is a U-shaped configuration in plan view). Then the housing section 56*f* could be placed in an open area between the two branches of the U, and the two tamper-indicating sections 58*f* could be under two side portions of the object to which the tamper-indicating device 54 is secured. In that instance, it could be that the tamper-indicating sections 58*f* could be spaced further from one another, or the center-located housing section 56*f* could be made at a greater length so as to extend further laterally.

Figure 13:
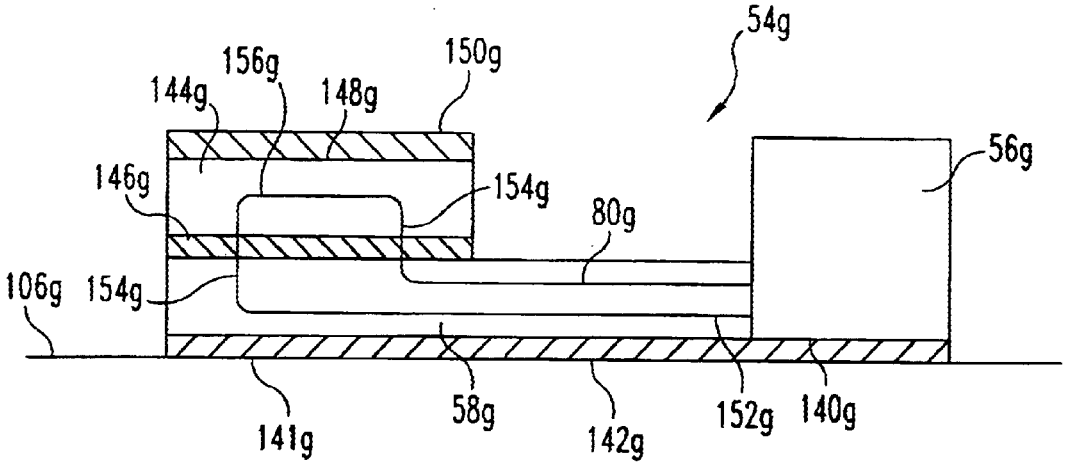
FIG. 13 is a view similar to FIG. 12, showing an eighth embodiment of the present invention.

An eighth embodiment is illustrated in FIG. 13. As in the description of prior embodiments, the components which are the same as, or similar to, components of any of the prior embodiments will be given like numerical designations, and in this instance, with a "g" suffix distinguishing those of this eighth embodiment. The depth of the RFID tag 54*g* is exaggerated for purposes of illustration.

The tag 54*g* comprises a housing 56*g* having a single tendril 58*g* extending outwardly therefrom. The bottom surface 140*g* of the housing 56*g* and the bottom surface 141*g* of the tendril 58*g* each have the same adhesive layer 142*g* that bonds both the housing 56*g* and the tendril 58*g* to the underlying surface 106*g*.

At the outer portion of the tendril 58*g* (i.e. further from the housing 56*g*) there is an additional tendril component 144*g* positioned immediately above an outer portion of the tendril member 58*g*, and this tendril component 144*g* has its lower surface bonded to the upper surface of the outer portion of the tendril 58*g* by a bonding layer 146*g*. The upper surface 148*g* of the upper tendril component 144*g* has a bonding layer 150*g*.

The wire member 80*g* has two first wire portions 152*g* which extend from the housing 56*g* through the main tendril member 58*g* and at the outer portion of the tendril member portions 152*g*, these two wire members 152*g* take an upturn at 154*g* to extend into the upper tendril component 144*g*. Then there is a connecting wire portion 156*g* which connects to the upper ends of the tendril portions 154*g*. Thus, these wire portions 152*g*, 154*g* and 156*g* form a continuous loop.

The lower bonding layer 142*g* and the upper bonding layer 148*g* make relatively strong bonds, while the intermediate bonding layer 146*g* makes a relatively weak bond.

Figure 14:
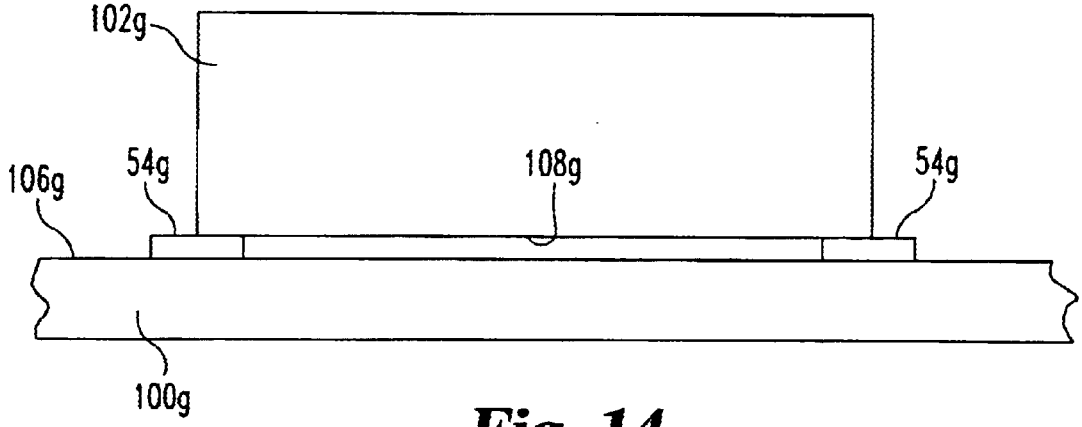
FIG. 14 is a side elevational view showing a couple of the tamper-indicating devices of FIG. 13 positioned under a security-sensitive item positioned on a support structure such as a tabletop.

To describe the operation of the eighth embodiment, reference is now made to FIG. 14, where it shows a pair of the RF tag members 54*g* positioned on a surface 106*g* of a table 100*g*, and there is shown an object, such as computer equipment 102*g* having a lower surface 108*g*. The lower surface 108*g* of the computer apparatus 102*g* is bonded to the upper bonding layer 148*g*, and the lower surface 140 of the housing 56*g* and the lower surface 141*g* of the tendril member 58*g* are bonded directly to the table surface 106*g* by the bonding layer 142*g*.

Let us now assume that someone is attempting to remove the computer apparatus 102*g* and also that this person recognizes that there may be some sort of security member between the apparatus 102*g* and the support member 100*g*. This person may simply wish to slide the computer member 102*g* over the table surface 106*g* in the hopes of foiling the action of the security member. However, with the arrangement of this eighth embodiment, the upper adhesive layer 148*g* will adhere strongly to the computer member 102*g*, while the lower bonding layer 142*g* will adhere strongly to the table top 106*g*. However, the relatively weak intermediate bonding layer 146*g* will give way and the upper tendril component 144*g* will slide laterally relative to the tendril member 58*g*. This will sever the two wire portions 154*g*.

Also, if it is attempted to raise one end of the computer apparatus 102*g* then again the upper tendril member 144*g* will separate from the lower tendril member 58*g*, also breaking the wire sections 154*g*. As in the previous embodiments, this will cause the operating components within the housing 56*g* to signal the alarm.

Figure 15:
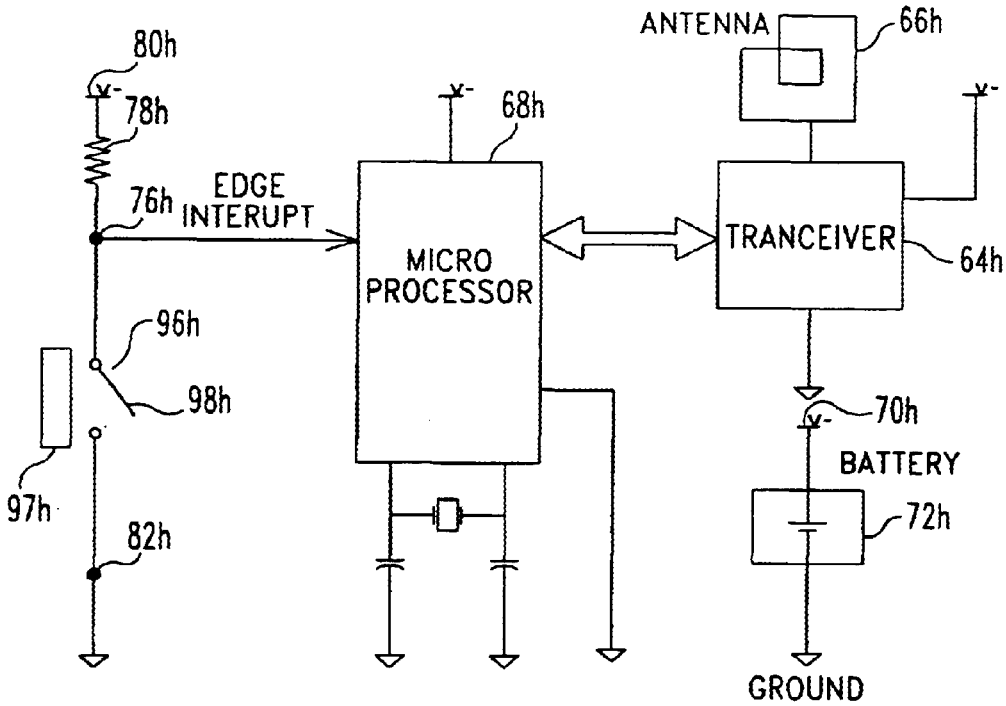
FIG. 15 is a schematic drawing of a tamper-indicating device of a ninth embodiment of the present invention.
Figure 16:
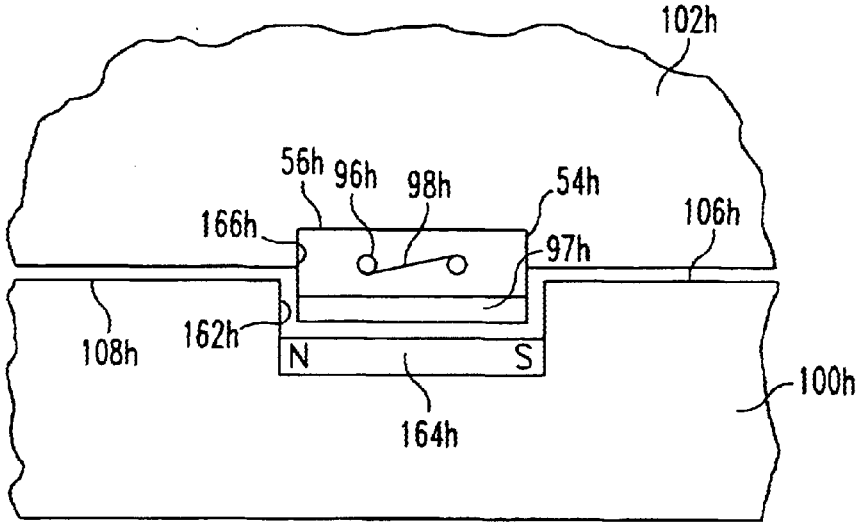
FIG. 16 is a side elevational view, partly in section, showing the tamper-indicating device of FIG. 15 in an operating position mounted into a security-sensitive object and positioned on a support structure such as a tabletop.

A ninth embodiment of the present invention is illustrated in FIGS. 15 and 16. As in the description of prior embodiments, the components of this ninth embodiment which are the same as, or similar to, components of the earlier embodiments will be given like numerical designations, but with an "h" designation distinguishing those of this ninth embodiment.

It is contemplated that within the broader scope of the present invention, the tamper-indicating section 57 of the first embodiment could utilize some component other than the wire 80, as shown in the first embodiment and other embodiments. Such an arrangement is shown in this ninth embodiment.

In FIG. 15, substantially the same circuitry is shown as in FIG. 5, except that instead of having the wire 80 of the tendril, there is shown a magnetic reed switch 96*h*, such as shown in FIG. 6*c*. However, instead of having the magnet 97*c* of FIG. 6*c* as being itself a magnet, there is shown a magnetically permeable member 97*c* which is closely adjacent to the magnetic reed switch element 98*h*, with this magnetically permeable member 97*h* being part of the RF tag 54*h*.

To explain the operation of this ninth embodiment, reference will now be made to FIG. 16. In FIG. 16 there is shown a stationary support structure 100*h*, which could be, for example, a counter top or a floor of a structure. This structure 100*h* has formed in its upper surface a recess 162*h*, and there is positioned in the lower part of this recess 162*h* a permanent magnet 164*h*. The RF tag or member 54*h* is arranged so that the magnetically permeable member 97*h* is positioned at the lower part of the housing 56*h*, and the magnetic reed switch 96*h* is positioned immediately adjacent to the magnetically permeable member 97*h*. Further, the housing 56*h* is shown as fitting into a recess 162*h* formed at the lower surface 108*h* of the security-sensitive object 102*h* (which as in prior embodiments could be a container with security-sensitive documents, computer equipment, etc.).

With the object 102*h* (e.g. a security-sensitive container) being positioned on the surface 106*h* of the support structure 100*h*, the lower portion of the housing 56*h* of the RF member 54*h* extends downwardly a short distance into the recess 162*h*. In this location, the magnetically permeable member 97*h* is in contact with the magnetic member 164*h*. (As shown in FIG. 16, there is a small gap between the magnetically permeable member 90*h* and the permanent magnet 164*h*, and this is simply being done for purposes of illustration to indicate that these are separate members).

Thus, the magnetic flux of the permanent magnet 164*h* permeates the magnetically permeable member 90*h* to in turn cause it to simply function as an extension of the magnet 164*h* and thus bring the reed switch 98 to its closed position. The magnetically permeable member 97*h* is made up of a magnetically permeable material which does not have "magnetic memory". Accordingly, as soon as the object 102*h* is moved upwardly so as to also lift the RF tag 54*h*, the air gap that is formed between the member 97*h* and the magnet 164*h* is created, with the magnetic flux in the member 90*h* decreasing substantially so that it is not able to maintain the switch member 98*h* in its closed position. Thus, when the switch 97*h* moves to its open position, this immediately sends a signal to the micro-controller to in turn produce an alarm signal.

Also, it is to be recognized, as with at least some of the other embodiments, that it is possible to arrange the RF tag 54*h* so that it responds to an interrogating signal, in which case a modulated response is made by the RF tag 54*h* to provide an "I'm okay" signal to the interrogating apparatus. In that case, when the object 102*h* is in a secured position, with the switch element 98*h* with the switch 80*h* being in its closed position (as shown in FIG. 16), it will be interrogated periodically and give the "I'm okay" signal, and then will not respond when the object 102*h* is moved out of its secured position of FIG. 16. But when the modulated response is not received, this indicates a possible security risk occurrence.

Figure 17:
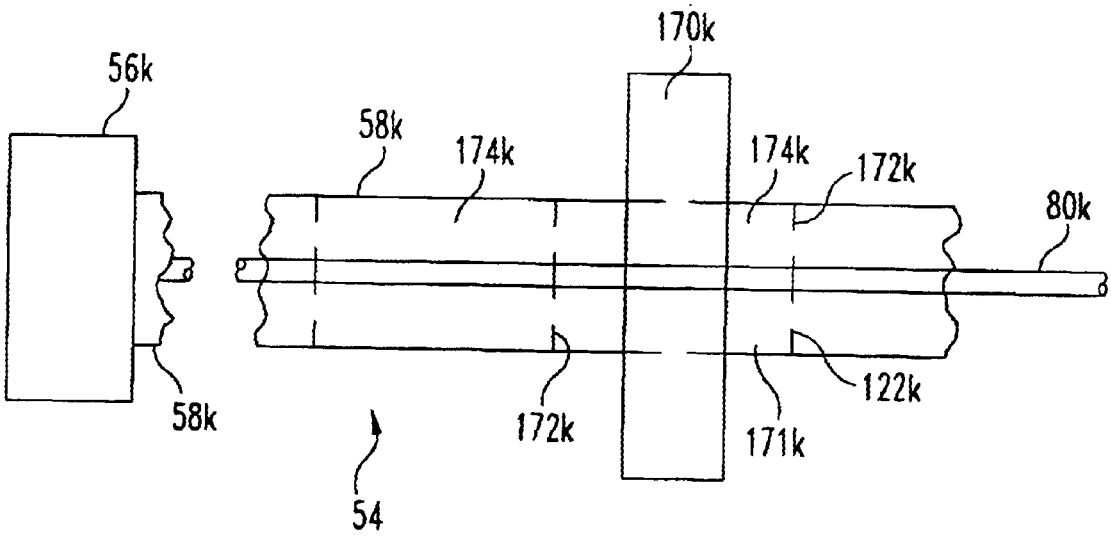
FIG. 17 is a top plan view showing a tenth embodiment of the present invention.
Figure 18:
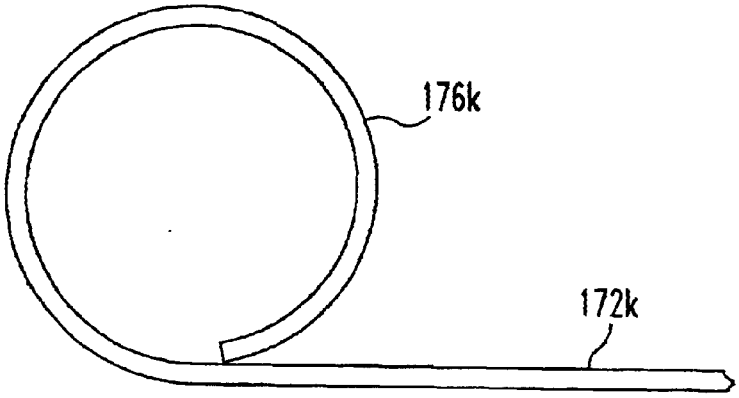
FIG. 18 is a view showing the portion of the tamper-indicating device of FIG. 17 with the elongated tamper-responsive section being in a rolled up configuration.

A tenth embodiment is shown with reference to FIG. 17 and 18. As with the description of the prior embodiments, components of this tenth embodiment which are similar to components of prior embodiments will be given like numerical designations with a "k" suffix distinguishing those of this tenth embodiment. This tenth embodiment utilizes an RF tag 54*k*, which is the same as the RF tag 54 of the first embodiment, where the wire extends from the contact point 76 to a ground location. In this tenth embodiment, instead of utilizing the wire 80*k* in a relatively short tendril 58, the wire 80*k* extended outwardly for a more substantial length, such as ten feet, twenty feet, etc., up to the limit permitted by the design. Conceivably, the length of this wire could even be one hundred feet or several hundred feet. This wire 80*k* could be formed as two wires having the outer ends connected to form a loop, or a single wire where the far end of the wire would simply be attached to a common ground with the RF tag 54*k*.

Part of the length of this wire 80*k* is shown, and there is illustrated schematically fasteners 170*k* at spaced locations also the wire 80*k*. These fasteners could be small adhesive strips. Also the wire 80*k* could be in or bonded to a plastic or fabric strip 171*k* with serrated "break" locations 172*k* at spaced intervals along its length where the wire 80*k* could be more easily broken.

It is apparent that if the break is made anywhere along the length of this wire 80*k*, this will cause the RF tag member 54*k* to send an alarm signal. One possible use for this tenth embodiment is, for example, where there is a location with various security-sensitive objects which would need to be made secure in a very short time. This strip 171*k* with the wire 80*k* and with its fasteners 170*k* could be wound up in a roll as shown at 176*k* in FIG. 17, and as the wire 80*k* with its attached strip 171*k* is unwound from the roll 176*k*, it could be wrapped over, across or around various objects, and also across openings of various sorts to create a more secured environment.

A possible modification of this tenth embodiment is that portions of this plastic strip are made with a bottom adhesive layer which is made with a rather high bonding strength in areas where there are the serrated break locations 122*k* arranged at spaced locations along the strip portion 172*k*. The bond strength of the adhesive layer is sufficiently strong so that if one section 174*k* between two break lines 122*k* is pulled up, the adjoining sections 174*k* would still adhere to the substrate, and the wire 80*k* would break at the break locations 122*k*. Thus, if an intruder is attempting to carefully remove the wire with the strip 172*k* carefully to avert detection, as soon as the person raises one of these sections 174*k* the break will occur and thus the alarm signal will be given.

At such time as they need for security in this particular location passes, then the information would be given to the control system that the alarm signal from the tag 54*k* would be disregarded so that the wire 80*k* with the many fasteners 170*k* and the strips 172*k* could all be removed from that temporarily secured area without triggering the alarm system.

It was indicated earlier in this text that the system of the present invention could advantageously be incorporated into one or more other security systems, and the one system in particular which was mentioned is described in the U.S. patent application entitled "Radio Frequency Personnel Alerting Security System and Method", naming the same inventors as in the present patent application.

Figure 19:
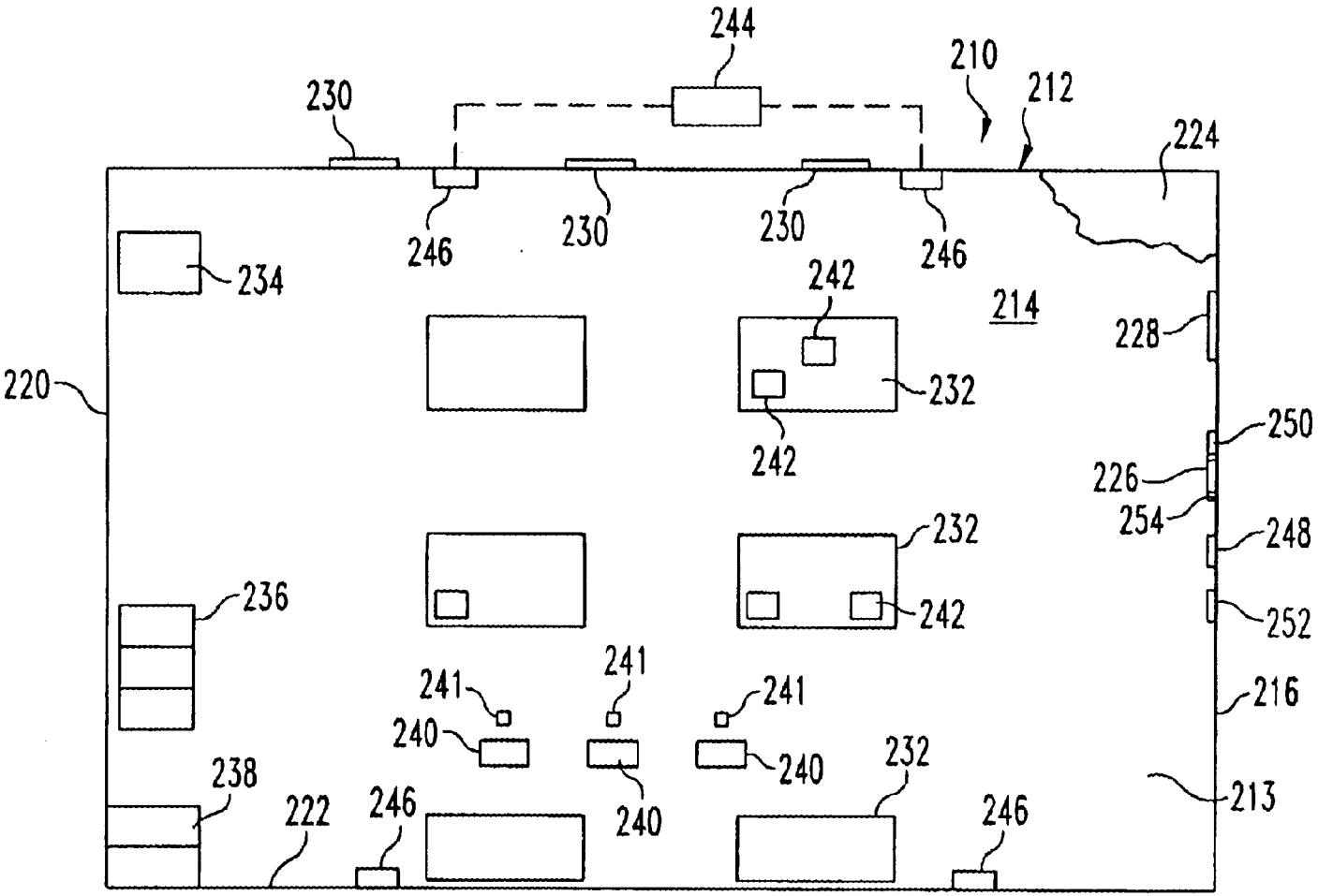
FIG. 19 is a plan view of a building facility, similar to FIG. 1, showing generally the same facility as shown in FIG. 1, but further showing components where the present invention is combined with a compatible security system.

The manner in which this is done will now be described with reference to FIGS. 19 and 20. It will readily be recognized that FIG. 19 shows substantially the same building facility as shown in FIG. 1, but with a few additions. The components shown in FIG. 19 which are the same as (or similar to) those shown in FIG. 1 will be given like numerical designations, but with the numeral "2" preceding the numerals that appear in FIG. 1. Thus, the building facility is designated 210 the building structure is designated 212, the desks are designated 232, the safe designated 234, etc.

With regard to the items which have been added to FIG. 19 and which do appear in FIG. 1 are several RFID tag members 241, each of which is shown being associated with a security-sensitive item 240. It will be recalled that earlier in this text it was indicated that these security-sensitive items 240 are items such as documents, computer discs, and other moveable items, which in their secured position are either locked in the vault 234 or locked in the file cabinets 236. However, during working hours when authorized personnel are present in the secured area 213, the security-sensitive items 240 could be outside of the secured location and, for example, on a person's desk.

There is also shown a monitoring and interrogation apparatus 244 which is operatively connected to one or more antennas. Four such antennas are shown at 246 and broken lines are shown at the top of FIG. 19 to indicate the operative connection of the two antennas 246 at the top of the page to the monitoring and interrogation apparatus 244. The two antennas 246 at the bottom of FIG. 19 have similar operative connections, but which are not shown for ease of illustration.

During non-working hours, during which the security-sensitive items 240 should be kept in a safe place, as indicated above, these items 240 could be kept either in the safe 234 or the locked file cabinets 236. Both the safe 234 and the locked file cabinets 236 are made of metal, and thus substantially block electromagnetic radiation or signals in the area.

To describe now the operation of the system of this additional security system, the monitoring and interrogation apparatus 244 sends out electromagnetic interrogation signals periodically through antennas 246 into the secured area 213. Each of the security-sensitive items 240 has attached to it an RFID tag 241, and with these sensitive security documents 240 being in the open, the interrogation signals will reach the RFID tags. Each tag 241 will send a response indicating "I am in an open area and not in my secured location". Now let us assume that the security-sensitive items 240 are locked in the safe 234 or the file cabinets 236. Then when the interrogation signals are sent out, there will be no reply from the RFID tags 241, and thus the interrogation and monitoring system 244 would recognize this as indicating that the items 240 are in their secured locations.

Let us take now a situation where the authorized personnel are in the building facility and working at their respective desks 232 and various documents 240 are on the desks of these persons. When the noon hour comes and all of the personnel in the secured area 213 are to leave for lunch, all of the security-sensitive items 240 should be placed in either the safe 234 or the locked file cabinets 236. Also the safe 234 and file cabinets 236 should be locked and RFID tags would be operatively connected to the locking mechanisms to indicate either a locked or unlocked condition. At this time the interrogation and control apparatus 244 would be sending out its interrogating signals. If no response signals are received, this would mean that all of the security-sensitive items 40 have been placed in the safe 234 or file cabinets 236, and that these have been locked.

However, let us assume that at the noon hour the interrogation and control apparatus 244 sends out its series of signals to each of the RFID tags 241 and receives a response from one or more of these tags 241, thus indicating that security-sensitive items are left in a non-secured location. When this occurs, the apparatus 244 sends the appropriate alarm signals to initiate precautionary action. This occurs as follows.

As soon as any one of the personnel in the security-sensitive area 213 approaches the exit door 226, a proximity detector 248 recognizes that one or more persons is about to leave the area 213 through the door 226. The proximity detector 248 signals this to the apparatus 244 which immediately sends alert signals to alert the personnel who are about to leave the area through the door 26 to the fact that the area 213 is not secure since some of the documents 240 or other security-sensitive items 240 are left out in the open. This alert signal is telling the personnel not to leave the secured area until proper steps should be taken to make sure these documents or other security-sensitive items 240 are placed either in the safe 234 or the file cabinets 236. When this is accomplished, and when the personnel approach the door 226, there are no such alarms given.

The alarm could be a visual display 250, or an audio alarm 252 (vocalizing words or some sort of other alarm signal), or both. Also, it could be that in addition to giving the alert signals access through the door would either be impeded or blocked in some manner, such as by the apparatus 244 activating a lock 254 on the door. Or there could be a mechanism which would simply impede opening the door 226 to give a physical signal to the personnel that that person should not be leaving the area. If the person would leave the area regardless of these alert signals, then another alarm signal (indicating a more urgent alarm) could be given and appropriate security measures being taken.

Then during the non-working hours, the interrogation and control apparatus 244 could still function to send out its interrogation signals to see if any of these security-sensitive documents 240 are being removed from their security-sensitive locations (either in the safe 234 or the locked file cabinets 236). If this is detected, then this would indicate that there has possibly been a covert entry into the secured area 213 and either the safe or the locked file cabinets 236 have been tampered with.

Other features of this system being described in FIG. 19 are contained in the full text of the other patent application (these naming the same inventors as in the present patent application). Since these are incorporated by reference to such patent application, these will not be repeated in this text.

Figure 20:
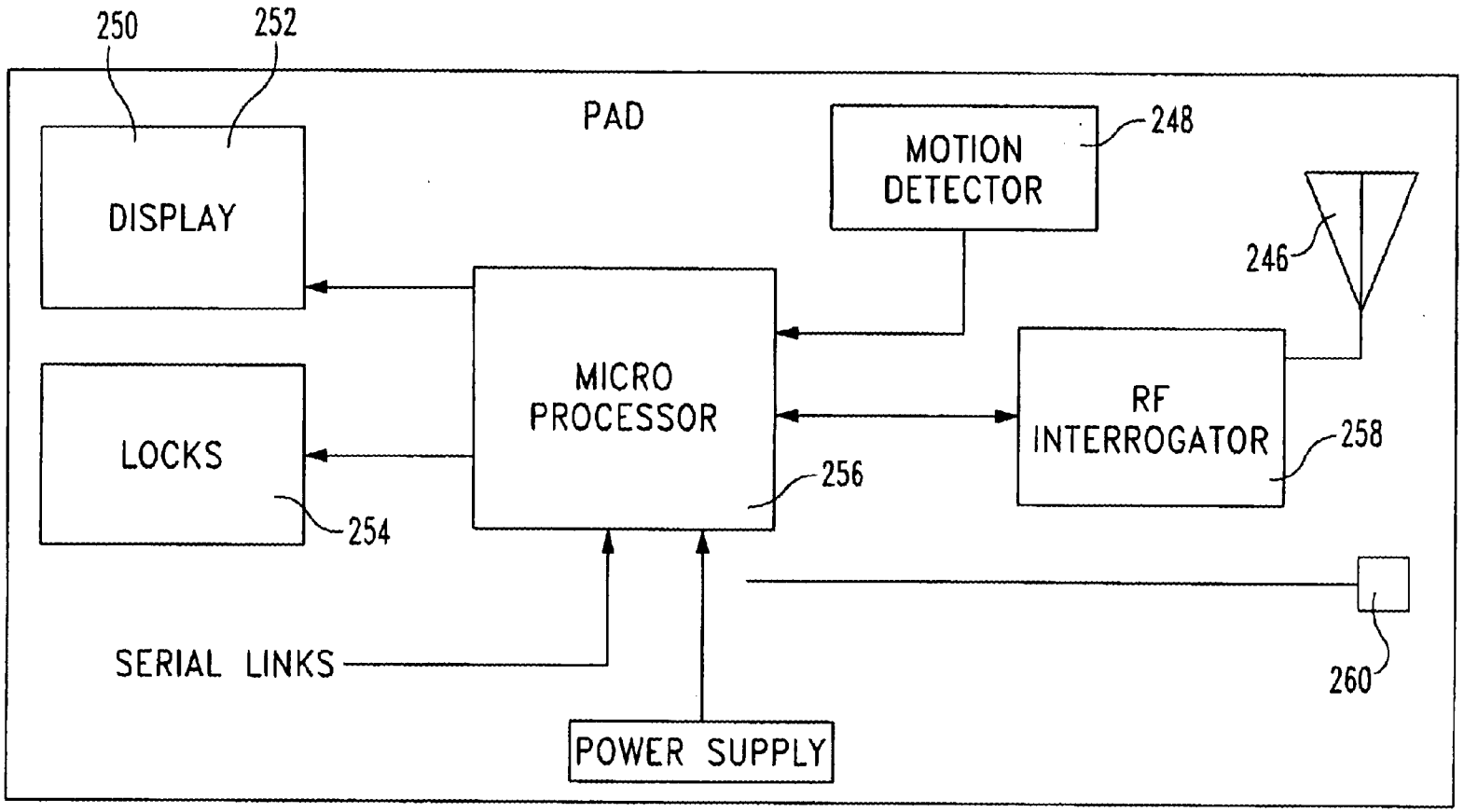
FIG. 20 is a schematic view of the interrogation and control apparatus utilized in the combined system shown in FIG. 19.

Reference is now made to FIG. 20, which shows schematically the main components of the interrogation and control apparatus shown in the other patent application. More specifically, there is indicated the motion detector (or other proximity detector) 248, the two displays 250 and 252, and also the antennas 246 and the lock or locks 254. There is a micro-controller 256 which is operatively connected to the RF interrogator 258 that in turn sends interrogation signals through the antennas 246. The motion detector 244 gives its input to the micro-controller 256 and the response to the interrogation signals come back through the antennas 246, and through the interrogator 258 back to the micro-controller. Other inputs are provided from the various sources, which are indicated schematically and collectively at 260.

As indicated above, this system shown in FIGS. 19 and 20 could be incorporated with the system of the present patent application, since the very same interrogation system and the antennas 246 could be used to send out the interrogation signals as needed, and also to receive the various alarm signals or "I'm okay" signals which would result from utilizing the system of the present invention.

Also, it becomes readily apparent from reviewing the operations of the present invention and also that the system of FIGS. 19 and 20 that these two systems complement each other in that these are directed to related but somewhat different security risks. Thus with these two systems working cooperatively with one another, the overall security of the area is enhanced.

With the system of the present invention and the system from the aforementioned U.S. patent application being combined, the interrogation and control apparatus 244 would also serve the function of the receiver/monitor 59 of the present invention. This interrogation and control apparatus would act as a receiver of signals from those tamper-indicating devices 54 or 60 which are able to generate and transmit the signal without any interrogation. However, for those embodiments of the tamper-indicating devices of the present invention which are passive and respond to an interrogating signal, then the interrogation and control apparatus 244 would be sending the interrogating signals and either be expecting a response or expecting no response for the items that are in the "I'm okay" condition.

In a preferred embodiment, the interrogating signals are sent sequentially and the interrogation is specific to each of the RFID tags or tampering indicating devices that are being monitored. Also the interrogation and control apparatus would have stored at its database the location of each tamper-indicating device (RFID tag) and the item or at least the type of item to which the tamper-indicating device (tag) attached or associated, and also its location. Therefore when the interrogations are made for the tags 241 that are associated with the security-sensitive items 240 (which should be available for interrogation only during certain periods) when the interrogating signals are sent, this would indicate the following.

During those periods where the security-sensitive items 240 are expected to be out of the locked file cabinets 236 or safe 234, then the response would be indicated as a signal indicating "I am present in the area of interrogation and therefore have not yet been taken out of this secured area". Further, if no response is received during the time periods where the items 240 are supposed to be in their secured location, the lack of a signal would indicate that these are in the safe 234 or the locked file cabinets 236. On the other hand a response during these periods where these items 240 are supposed to be securely placed in the file cabinets 236 and 234 would indicate a security risk occurrence.

With regard to the items 242, as indicated above for the some of the tamper-indicating devices, such as the device 54 of the present invention, the interrogation and control apparatus 244 may never receive a signal from those items 242, since they would not have been tampered with and their tamper-indicating devices would remain in the intact position. For other items 242 which have their tamper-indicating devices or RFID tags passive, then a response would be a expected, and this would be a signal indicating "I'm okay; my tamper-responsive section is intact". On the other hand, a lack of a signal in response to an interrogation from the passive RFID tags would indicate that the tamper-indicating device 54 was in its non-intact position and would indicate a possibility of a security risk occurrence.

It is obvious that various modifications could be made to the present invention without departing from the basic teachings thereof, and the claims of the invention are intended to be interpreted to cover such modifications or variations.

We claim:

1. A method of reducing security risks in or adjacent to a building facility where there are in, or proximate to, said building facility components which comprise one or more of the following:

a) building components which are part of, or associated with, a building of said building facility;

b) facility components which are in or adjacent to said building and relate to functions or occupancy of the building facility;

c) other components which are in or adjacent to said building facility but are not included in building components or facility components, and which components are also categorized as:

a) security-sensitive components which comprise:

i) components which themselves are security-sensitive;

ii) components which are of a nature that if moved or otherwise tampered with in some manner, such tampering may indicate a security risk;

iii) components which both themselves are security-sensitive and also are of a nature that if moved or otherwise tampered with in some manner, such tampering may indicate a security risk;

b) non-security-sensitive components;

said method comprising:

a) providing at least one tamper-indicating device which comprises:

i) a tamper-responsive section which comprises at least one tamper-responsive portion which has an intact condition and a non-intact condition, and said tamper-responsive section has an electrically conductive portion which in the intact condition is able to conduct electricity between first and second tamper related locations and in the non-intact condition is not able to conduct electricity between said first and second tamper related locations;

ii) a tamper-signaling section operatively connected to said tamper-responsive section in a manner to provide a signal indicating at least one of a non-intact condition, an intact condition, or not provide a signal in response to an interrogating signal to indicate a non-intact condition or intact condition;

b) placing said tamper-indicating device in a security risk detecting position by operatively engaging said tamper-indicating device to two of said components, at least one of which is a security-sensitive component, said two components being characterized in that relative movement between said two components indicates a possibility of a security risk occurrence, said tamper-indicating device being arranged and connected to said two components so that relative movement between said two components causes a break or damage to said tamper-responsive section to cause the tamper-responsive section to go to its non-intact condition;

c) operating a signal receiving device to ascertain either a reception of a signal or a lack of a signal from said tamper-indicating device to ascertain said possible security risk occurrence.

2. The method as recited in claim 1, wherein said tamper-indicating device transmits its tamper-indicating signal in response to said tamper-responsive section going to its non-intact condition.

3. The method as recited in claim 2, wherein said tamper-indicating device has a sleep mode which exists so long as the tamper-responsive section is in its intact condition, said method further comprising causing said tamper-indicating device to go from the sleep mode to an active mode upon occurrence of the tamper-responsive section going to its non-intact condition to in turn cause the tamper-signaling section to transmit the tamper-indicating signal.

4. The method as recited in claim 3, wherein said electrically conductive portion in the intact position causes said tamper-indicating device to remain in its sleep mode, and in the non-intact condition causes the tamper-indicating device to go to its active mode.

5. The method as recited in claim 4, further comprising operatively connecting said electrically conductive portion into circuitry of said tamper-signaling section, and with the electrically conductive portion in its intact position, providing an input to the micro-controller of said tamper-signaling section at a first voltage level, and with the electrically conductive portion in its non-intact position providing an input to the micro-controller is at another voltage level, with the change from the first voltage level to the second voltage level causing the micro-controller to place the tamper-signaling section into its active mode.

6. The method as recited in claim 1, further comprising transmitting interrogating signals to said tamper-indicating device, with said tamper-indicating device modulating said signal in response to said interrogating signal and transmitting a modulated response when there is an intact condition of the tamper-responsive section, and not transmitting the modulated response when a non-intact condition exists, to indicate a possibility of a security risk.

7. The method as recited in claim 6, further comprising energizing said tamper-indicating device by the interrogating signal with the tamper-responsive section in its intact condition to provide said modulated response.

8. The method as recited in claim 7, further comprising operatively connecting said electrically conductive portion into circuitry of the tamper-signaling section, and when the electrically conductive portion is conductive, causing energizing current from the interrogating signal to provide the modulated response to the interrogating signal.

9. The method as recited in claim 1, further comprising positioning operating components of tamper-signaling section within a housing of said tamper-signaling section, with said operating components being responsive to the tamper-responsive section, providing said tamper-responsive section with a plurality of tamper-responsive portions, and operatively connecting the tamper-responsive portions to the tamper-signaling section in a manner that the signal transmitting section responds to any one of these tamper-responsive portions being in its intact or non-intact condition.

10. The method as recited in claim 1, further comprising connecting a first connecting portion of said tamper-indicating device to one of said two components, and connecting a second connecting portion of the tamper-indicating device to the other of said two components, with a tamper-responsive region of this tamper-responsive section being positioned between said first and second connecting portions in a manner that relative movement of said two components stresses the tamper-responsive region to cause the break or damage to the electrically conductive portion.

11. The method as recited in claim 10, wherein said two components have facing surfaces adjacent to one another, said method further comprising positioning said tamper-indicating device between said two facing surfaces, with the first connecting portion of the tamper-indicating device being connected to the facing surface of one of said two components, and the second connecting portion being connected to the other of said components, in a manner that relative movement of said two components that moves the two facing surfaces apart causes the damage or break in the electrically conductive portion.

12. The method as recited in claim 11, further comprising positioning at least portions of a plurality of tamper-indicating devices between the two facing surfaces, with the tamper-indicating devices positioned so that relative rotational movement of said components to rotate the facing surfaces away from one another causes at least one of the tamper-indicating devices to go to its non-intact position.

13. The method as recited in claim 10, wherein the first and second connecting portions of the tamper-indicating device are located on said tamper-responsive section, said method further comprising connecting said tamper-indicating device to surfaces of the two components which are in general alignment with one another and spaced from one another.

14. The method as recited in claim 1, wherein there is in or adjacent to the building facility a security-sensitive area, and there are building-related components at or in the vicinity of said security-sensitive area, said method further comprising operatively connecting a plurality of said tamper-indicating devices to at least some of said building components to detect movement of said building components that may indicate a security risk.

15. The method as recited in claim 14, wherein said building components comprise a plurality of ceiling components at said security-sensitive area, and said tamper-indicating devices have operative connections to said ceiling components.

16. The method as recited in claim 15, wherein said ceiling components comprise ceiling tiles extending across a ceiling area, and at least some of said tamper-indicating devices have a plurality of tamper-responsive members of the tamper-responsive section of the tamper-indicating devices, with the tamper-responsive members being connected to ceiling tiles, whereby movement of one ceiling tile would indicate a possible security risk.

17. The method as recited in claim 1, wherein at least one of said two components is a portable security-sensitive component, and the other said component has a support surface on which the one component is positioned, said method further comprising connecting said tamper-indicating device to said two components so that movement of said portable security-sensitive component relative to the other component causes the tamper-indicating device to go to its non-intact condition.

18. The method as recited in claim 1, wherein said tamper-responsive section is an elongate member having a weakened location between said first and second tamper-related locations so that the tamper-responsive section is more likely to be damaged or broken under stress at said weakened location.

19. The method as recited in claim 1, wherein said tamper-responsive section is an elongate strip, said method further comprising positioning said elongate strip over a plurality of security-sensitive components, and adhering said elongate strip to said security-sensitive components whereby movement of any one of said security-sensitive components that would indicate a security risk would cause said tamper-responsive section to be in its it non-intact condition.

20. The method as recited in claim 19, wherein said strip is also attached to non-security-sensitive components.

21. A system of reducing security risks in or adjacent to a building facility where there are in, or proximate to, said building facility components which comprise one or more of the following:

a) building components which are part of, or associated with, a building of said building facility;

b) facility components which are in or adjacent to said building and relate to functions or occupancy of the building facility;

c) other components which are in or adjacent to said building facility but are not included in building components or facility components, and which components are also categorized as:

a) security-sensitive components which comprise:

i) components which themselves are security-sensitive;

ii) components which are of a nature that if moved or otherwise tampered with in some manner, such tampering may indicate a security risk;

iii) components which both themselves are security-sensitive and also are of a nature that if moved or otherwise tampered with in some manner, such tampering may indicate a security risk;

b) non-security-sensitive components;

said system comprising:

a) at least one tamper-indicating device which comprises:

i) a tamper-responsive section which comprises at least one tamper-responsive portion which has an intact condition and a non-intact condition, and said tamper-responsive section has an electrically conductive portion which in the intact condition is able to conduct electricity between first and second tamper related locations and in the non-intact condition is not able to conduct electricity between said first and second tamper related locations;

ii) a tamper-signaling section operatively connected to said tamper-responsive section in a manner to provide a signal indicating at least one of a non-intact condition, an intact condition, or not provide a signal in response to an interrogating signal to indicate a non-intact condition or intact condition;

b) said tamper-indicating device being placed in a security risk detecting position operatively engaging two of said components, at least one of which is a security-sensitive component, said two components being characterized in that relative movement between said two components indicates a possibility of a security risk occurrence, said tamper-indicating device being arranged and connected to said two components so that relative movement between said two components causes a break or damage to said tamper-responsive section to cause the tamper-responsive section to go to its non-intact condition;

c) a receiver/monitoring section arranged to receive said signal in a manner to ascertain either a reception of a signal or a lack of a signal from said tamper-indicating device to ascertain said possible security risk occurrence.

22. The system as recited in claim 21, wherein said tamper-indicating device is arranged to transmit its tamper-indicating signal in response to said tamper-responsive section going to its non-intact condition.

23. The system as recited in claim 22, wherein said tamper-indicating device has a sleep mode which exists so long as the tamper-responsive section is in its intact condition, said tamper-indicating device being arranged to go from the sleep mode to an active mode upon occurrence of the tamper-responsive section going to its non-intact condition to in turn cause the tamper-signaling section to transmit the tamper-indicating signal.

24. The system as recited in claim 23, wherein said tamper-indicating device is arranged so that said electrically conductive portion in the intact position causes said tamper-indicating device to remain in its sleep mode, and in the non-intact condition causes the tamper-indicating device to go to its active mode.

25. The system as recited in claim 24, wherein said tamper-signaling section comprises a micro-controller and circuitry which arranged in a manner that with the electrically conductive portion in its intact position, an input to said micro-controller is at a first voltage level, and with the electrically conductive portion in its non-intact position, said input to the micro-controller is at another voltage level, with the change from the first voltage level to the second voltage level causing the micro-controller to place the tamper-signaling section into its active mode.

26. The system as recited in claim 21, wherein said receiver/monitoring section is arranged to transmit interrogating signals to said tamper-indicating device, and said tamper-indicating device is arranged to modulate said signal in response to said interrogating signal so that a modulated response is transmitted when there is an intact condition of the tamper-responsive section, and the modulated response is not transmitted when a non-intact condition exists, to indicate a possibility of a security risk.

27. The system as recited in claim 26, wherein said tamper-indicating device with the tamper-responsive section in its intact condition is energized by the interrogating signal to provide said modulated response.

28. The system as recited in claim 27, wherein said electrically conductive portion is operatively connected into circuitry of the tamper-signaling section so that when the electrically conductive portion is conductive, energizing current from the interrogating signal is able to cause the modulated response to the interrogating signal.

29. The method as recited in claim 21, wherein said tamper-signaling section comprises operating components which are positioned within a housing of said tamper-responsive section, said tamper-responsive section comprising a plurality of tamper-responsive portions which are operatively connected to the tamper-signaling section in a manner that the signal-transmitting section responds to any one of these tamper-responsive portions being in its intact or non-intact condition.

30. The system as recited in claim 21, wherein a first connecting portion of said tamper-indicating device is connected to one of said two components, and a second connecting portion of the tamper-indicating device is connected to the other of said two components, with a tamper-responsive region of this tamper-responsive section being positioned between said first and second connecting portions in a manner that relative movement of said two components stresses the tamper-responsive region to cause the break or damage to the electrically conductive portion.

31. The system as recited in claim 30, wherein said two components have facing surfaces adjacent to one another, and said tamper-indicating device is positioned between said two facing surfaces, with the first connecting portion of the tamper-indicating device being connected to the facing surface of one of said two components, and the second connecting portion being connected to the facing surface of the other of said components, in a manner that relative movement of said two components that moves the two facing surfaces apart causes the damage or break in the electrically conductive portion.

32. The system as recited in claim 31, where there is a plurality of tamper-indicating devices, at least portions of which are positioned between the two facing surfaces and connecting to the facing surfaces, and the tamper-indicating devices are arranged at spaced locations so that relative rotational movement of said components to rotate the facing surfaces away from one another causes at least one of the tamper-indicating devices to go to its non-intact position.

33. The system as recited in claim 32, wherein the first and second connecting portions of the tamper-indicating device are located on said tamper-responsive section, and said tamper-responsive section is connected to surfaces of the two components which are in general alignment with one another and spaced from one another.

34. A method of reducing security risks in or adjacent to a building facility where there are in, or proximate to, said building facility components which comprise one or more of the following:

a) building components which are part of, or associated with, a building of said building facility;

b) facility components which are in or adjacent to said building and relate to functions or occupancy of the building facility;

c) other components which are in or adjacent to said building facility but are not included in building components or facility components, and which components are also categorized as:

a) security-sensitive components which comprise:

i) components which themselves are security-sensitive;

ii) components which are of a nature that if moved or otherwise tampered with in some manner, such tampering may indicate a security risk;

iii) components which both themselves are security-sensitive and also are of a nature that if moved or otherwise tampered with in some manner, such tampering may indicate a security risk;

b) non-security-sensitive components; said method comprising:

a) providing at least one tamper-indicating device which comprises:

i) a tamper-responsive section which comprises at least one tamper-responsive portion which has an intact condition and a non-intact condition, and said tamper-responsive section has a damage-sensitive portion located between first and second tamper-related locations;

ii) a tamper-signaling section operatively connected to said tamper-responsive section in a manner to provide a signal indicating at least one of a non-intact condition, an intact condition, or not provide a signal in response to an interrogating signal to indicate a non-intact condition or intact condition;

b) placing said tamper-indicating device in a security risk detecting position by operatively engaging said tamper-indicating device to two of said components, at least one of which is a security-sensitive component, said two components being characterized in that relative movement between said two components indicates a possibility of a security risk occurrence, said tamper-indicating device being arranged and connected to said two components so that relative movement between said two components causes a break or damage to said tamper-responsive section to cause the tamper-responsive section to go to its non-intact condition;

c) operating a signal receiving device to ascertain either a reception of a signal or a lack of a signal from said tamper-indicating device to ascertain said possible security risk occurrence.

35. The method as recited in claim 34, wherein said tamper-indicating device transmits its tamper-indicating signal in response to said tamper-responsive section going to its non-intact condition.

36. The method as recited in claim 35, wherein said tamper-indicating device has a sleep mode which exists so long as the tamper-responsive section is in its intact condition, said method further comprising causing said tamper-indicating device to go from the sleep mode to an active mode upon occurrence of the tamper-responsive section going to its non-intact condition to in turn cause the tamper-signaling section to transmit the tamper-indicating signal.

37. The method as recited in claim 36, wherein said electrically conductive portion in the intact position causes said tamper-indicating device to remain in its sleep mode, and in the non-intact condition causes the tamper-indicating device to go to its active mode.

38. The method as recited in claim 34, further comprising transmitting interrogating signals are transmitted to said tamper-indicating device, with said tamper-indicating device modulating said signal in response to said interrogating signal and transmitting a modulated response when there is an intact condition of the tamper-responsive section, and not transmitting the modulated response when a non-intact condition exists, to indicate a possibility of a security risk.

39. The method as recited in claim 38, further comprising energizing said tamper-indicating device by the interrogating signal with the tamper-responsive section in its intact condition is to provide said modulated response.

40. The method as recited in claim 39, further comprising positioning operating components of tamper-signaling section are within a housing of said tamper-signaling section, with said operating components being responsive to the tamper-responsive section, providing said tamper-responsive section with a plurality of tamper-responsive portions, and operatively connecting the tamper-responsive portions to the tamper-signaling section in a manner that the signal transmitting section responds to any one of these tamper-responsive portions being in its intact or non-intact condition.

* * * * *